US005716772A

United States Patent [19]

Taguchi

[11] Patent Number: 5,716,772

[45] Date of Patent: Feb. 10, 1998

[54] SILVER HALIDE PHOTOGRAPHIC MATERIAL

[75] Inventor: Toshiki Taguchi, Kanagawa, Japan

[73] Assignee: Fuji Photo Film Co., Ltd., Kanagawa, Japan

[21] Appl. No.: 710,719

[22] Filed: Sep. 20, 1996

[30] Foreign Application Priority Data

Sep. 22, 1995 [JP] Japan ..... 7-244698

[51] Int. Cl.[6] ..... G03C 1/42; G03C 1/498; G03C 7/413

[52] U.S. Cl. ..... 430/543; 430/351; 430/380; 430/442; 430/467; 430/566

[58] Field of Search ..... 430/203, 218, 430/380, 442, 467, 351, 543, 566

[56] References Cited

U.S. PATENT DOCUMENTS

| | | | |
|---|---|---|---|
| 3,737,316 | 6/1973 | Salminen et al. | 430/553 |
| 3,801,321 | 4/1974 | Evans et al. | 430/619 |
| 4,021,240 | 5/1977 | Cerquone et al. | 430/203 |
| 4,430,415 | 2/1984 | Aono et al. | 430/203 |
| 4,447,523 | 5/1984 | Ross et al. | 430/551 |
| 4,463,079 | 7/1984 | Naito et al. | 430/203 |
| 4,952,474 | 8/1990 | Tsukahara et al. | 430/203 |

FOREIGN PATENT DOCUMENTS

| | | | |
|---|---|---|---|
| 098072 | 1/1984 | European Pat. Off. . | |
| 320821 | 6/1989 | European Pat. Off. . | |
| 2193216 | 2/1974 | France . | |
| 118835 | 6/1985 | Japan . | |
| 60-128438 | 7/1985 | Japan | G03C 7/00 |

*Primary Examiner*—Richard L. Schilling
*Attorney, Agent, or Firm*—Sughrue, Mion, Zinn, Macpeak & Seas, PLLC

[57] ABSTRACT

Provided is a silver halide photographic material excellent in discrimination, which comprises on a support at least one compound represented by formula (1):

(1)

wherein $R_1$ to $R_4$ each represents a hydrogen atom or a substituent, with the proviso that the sum of the Hammett substituent constants $\sigma_p$ values of $R_1$ to $R_4$ is 0 or more; and $R_5$ to $R_9$ each represents a hydrogen atom or a substituent and at least one of $R_5$ and $R_9$ is a substituent, wherein $R_1$ and $R_2$, $R_5$ and $R_6$, $R_6$ and $R_7$, $R_7$ and $R_8$, or $R_8$ and $R_9$ may combine with each other to form a ring.

15 Claims, No Drawings

SILVER HALIDE PHOTOGRAPHIC MATERIAL

FIELD OF THE INVENTION

The present invention relates to a silver halide photographic material, specifically to a silver halide photographic material (especially, a heat developable color photographic material) excellent in image discrimination.

BACKGROUND OF THE INVENTION

Photographic methods using silver halides are excellent in photographic characteristics such as sensitivity and gradation control, as compared with other photographic methods such as electrophotographic methods and diazo photographic methods, and therefore have previously been most widely used. In particular, the photographic methods using silver halides provide highest image quality as color hard copies, so that intensive investigation has recently been conducted on them.

In recent years, systems which can obtain images easily and rapidly have been developed by shifting image formation processing of photographic materials using silver halides from conventional wet processing to instant photographic systems containing a developing solution and further to dry heat development processing by heating. Heat developable photographic materials are described in *Shashin Kohgaku no Kiso* (*Higinen Shashin*) (*The Fundamentals of Photographic Engineering (Nonsilver Photograph)*), infra page 242, Corona Publishing Co. Ltd. However, black-and-white image forming methods represented by dry silver are merely described therein. Recently, commercial products such as Pictorography and Pictorostat supplied from Fuji Photo Film Co., Ltd. have been put on the market. The above-mentioned easy rapid processing methods use a redox color material to which a preformed dye is attached to form color images. Methods utilizing coupling reaction of a coupler and an oxidized product of a developing agent are most general as the color image forming methods of photographic materials. As to heat developable color photographic materials employing these methods, many ideas are also applied for patents, for example, U.S. Pat. Nos. 3,761,270 and 4,021,240, JP-A-59-231539 (the term "JP-A" as used herein means an "unexamined published Japanese patent application") and JP-A-60-128438. The above-mentioned heat developable photographic materials are characterized by containing reducible developing agents.

The present inventors have also studied the above-mentioned heat developable color photographic materials, and have found that sulfonamidophenols as described in U.S. Pat. No. 4,021,240, JP-A-60-128438, etc. are compounds excellent in discrimination and raw stock storability, when they are incorporated in the photographic materials. In addition, the system using couplers and reducible developing agents is advantageous in sensitivity, as compared with the system using the color materials to which preformed dyes are linked, because couplers have no absorption in the visible region before processing, and has the advantage that it can be employed not only for photographic printing materials but also for photographing materials. The study has therefore been advanced. From such a viewpoint, the present inventors have synthesized various compounds to examine the potential of p-sulfonamidophenols as a developing agent. The result has revealed that the sulfonamidophenols are compounds excellent in raw stock storability and giving color images excellent in discrimination, but the generation efficiency of a dye in developed portion is as low as 10 to 60%.

Then, the dye generation efficiency in a developed portion at the time when the p-sulfonamidophenols are used as the color developing agent has been investigated. As a result, the present inventors have discovered that a compound having an aryl group as a substituent for the sulfonyl group and a substituent group at the ortho position thereof is very highly active. In search of more preferred compounds, the present inventors have also discovered that another important factors reside in that the releasing group has an electron-donating ballasting group as well as that the substituent at the ortho position is bulky.

SUMMARY OF THE INVENTION

An object of the present invention is to provide a silver halide photographic material excellent in discrimination, particularly a heat developable color photographic material.

The object of the present invention can be accomplished by the following photographic materials.

(1) A silver halide photographic material comprising on a support at least one compound represented by formula (1):

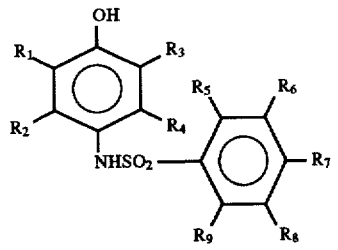

(1)

wherein $R_1$ to $R_4$ each represents a hydrogen atom or a substituent, with the proviso that the sum of the Hammett substituent constants $\sigma_p$ values of $R_1$ to $R_4$ is 0 or more; and $R_5$ to $R_9$ each represents a hydrogen atom or a substituent and at least one of $R_5$ and $R_9$ is a substituent, wherein $R_1$ and $R_2$, $R_5$ and $R_6$, $R_6$ and $R_7$, $R_7$ and $R_8$, or $R_8$ and $R_9$ may combine with each other to form a ring.

(2) A silver halide photographic material of item (1), wherein $R_4$ is a hydrogen atom and at least one of $R_5$ and $R_9$ is a halogen atom, an amino group, an alkyl group, an aryl group, an acylamino group, a sulfonamido group, an alkoxycarbonylamino group, an aryloxycarbonylamino group, an ureido group, a phosphorylamino group, an alkoxycarbonyl group, an aryloxycarbonyl group, an alkylsulfonyl group, an arylsulfonyl group, an acyloxy group, or a carbamoyloxy group.

(3) A silver halide photographic material of the item (1) or (2), wherein the sum of the Hammett substituent constants $\sigma$ values of $R_5$ to $R_9$ is 0 or less.

(4) A silver halide photographic material of the item (1), (2) or (3), wherein at least one of $R_1$ to $R_4$ has a ballasting group having 8 or more carbon atoms, or the total carbon number of $R_5$ to $R_9$ is 8 or more.

(5) A silver halide photographic material of the item (1), (2), (3) or (4), wherein the total carbon number of $R_5$ and $R_9$ is 6 or more.

(6) A heat developable color photographic material comprising a support having provided thereon a photosensitive silver halide, a binder, a coupler, and at least one compound represented by formula (1) shown in item (1) wherein $R_1$ to $R_4$ each represents a hydrogen atom or a substituent, with the proviso that the sum of the Hammett substituent constants $\sigma_p$ values of $R_1$ to $R_4$ is 0 or more; and $R_5$ to $R_9$ each represents a hydrogen atom or a substituent and at least one of $R_5$ and $R_9$ is a substituent, wherein $R_5$ and $R_6$ or $R_8$ and $R_9$ may combine with each other to form a ring.

(7) The heat developable color photographic material of item (6), wherein $R_4$ is a hydrogen atom and at least one of $R_5$ and $R_9$ is a halogen atom, an amino group, an alkyl group, an aryl group, an acylamino group, a sulfonamido group, an alkoxycarbonylamino group, an aryloxycarbonylamino group, an ureido group, a phosphorylamino group, an alkoxycarbonyl group, an aryloxycarbonyl group, an alkylsulfonyl group, an arylsulfonyl group, an acyloxy group, or a carbamoyloxy group.

(8) The heat developable color photographic material of item (6), wherein the sum of the Hammett substituent constants σ values of $R_5$ to $R_9$ is 0 or less.

(9). The heat developable color photographic material of item (6), wherein at least one of $R_1$ to $R_3$ has a ballasting group having 8 or more carbon atoms or the total carbon number of $R_5$ to $R_9$ is 8 or more.

DETAILED DESCRIPTION OF THE INVENTION

The present invention will be described in detail below.

First, the compounds represented by formula (1) are described in detail.

The compounds represented by formula (1) are developing agents (color developing agents) generically named p-sulfonamidophenols.

In formula (1), $R_1$ to $R_4$ each represents a hydrogen atom or a substituent, with the proviso that the sum of the Hammett substituent constants of $R_1$ to $R_4$ is 0 or more. Preferred examples of the substituent include a halogen atom, an alkyl group, an aryl group, an alkylcarbonamido group, an arylcarbonamido group, an alkylsulfonamido group, an arylsulfonamido group, an alkoxyl group, an aryloxy group, an alkylthio group, an arylthio group, an alkylcarbamoyl group, an arylcarbamoyl group, a carbamoyl group, an alkylsulfamoyl group, an arylsulfamoyl group, an sulfamoyl group, a cyano group, an alkylsulfonyl group, an arylsulfonyl group, an alkoxycarbonyl group, an aryloxycarbonyl group, an alkylcarbonyl group, an arylcarbonyl group or an acyloxy group.

In particular, $R_1$ to $R_4$ each represents a hydrogen atom, a halogen atom (for example, chlorine or bromine), an alkyl group (preferably having from 1 to 80 carbon atoms, for example, methyl, ethyl, isopropyl, n-butyl or t-butyl), an aryl group (preferably having from 6 to 80 carbon atoms, for example, phenyl, tolyl or xylyl), an alkylcarbonamido group (preferably having from 2 to 80 carbon atoms, for example, acetylamino, propionylamino or butyroylamino), an arylcarbonamido group (preferably having from 7 to 80 carbon atoms, for example, benzoylamino), an alkylsulfonamido group (preferably having from 1 to 80 carbon atoms, for example, methanesulfonylamino or ethanesulfonylamino), an arylsulfonamido group (preferably having from 6 to 80 carbon atoms, for example, benzenesulfonylamino or toluene-sulfonylamino), an alkoxyl group (preferably having from 1 to 80 carbon atoms, for example, methoxy or ethoxy), an aryloxy group (preferably having from 6 to 80 carbon atoms, for example, phenoxy), an alkylthio group (preferably having from 1 to 80 carbon atoms, for example, methylthio, ethylthio or butylthio), an arylthio group (preferably having from 6 to 80 carbon atoms, for example, phenylthio or tolylthio), an alkylcarbamoyl group (preferably having from 2 to 80 carbon atoms, for example, methyl-carbamoyl, dimethylcarbamoyl, ethylcarbamoyl, diethylcarbamoyl, dibutylcarbamoyl, piperidylcarbamoyl or morpholylcarbamoyl), an arylcarbamoyl group (preferably having from 7 to 80 carbon atoms, for example, phenylcarbamoyl, methylphenylcarbamoyl, ethylphenylcarbamoyl or benzylphenylcarbamoyl), a carbamoyl group, an alkylsulfamoyl group (preferably having from 1 to 80 carbon atoms, for example, methylsulfamoyl, dimethylsulfamoyl, ethylsulfamoyl, diethylsulfamoyl, dibutylsulfamoyl, piperidylsulfamoyl or morpholylsulfamoyl), an arylsulfamoyl group (preferably having from 6 to 80 carbon atoms, for example, phenylsulfamoyl, methylphenylsulfamoyl, ethylphenylsulfamoyl or benzylphenylsulfamoyl), a sulfamoyl group, a cyano group, an alkylsulfonyl group (preferably having from 1 to 80 carbon atoms, for example, methanesulfonyl or ethanesulfonyl), an arylsulfonyl group (preferably having from 6 to 80 carbon atoms, for example, phenylsulfonyl, 4-chlorophenylsulfonyl or p-toluenesulfonyl), an alkoxycarbonyl group (preferably having from 2 to 80 carbon atoms, for example, methoxycarbonyl, ethoxycarbonyl or butoxycarbonyl), an aryloxycarbonyl group (preferably having from 7 to 80 carbon atoms, for example, phenoxycarbonyl), an alkylcarbonyl group (preferably having from 2 to 80 carbon atoms, for example, acetyl, propionyl or butyroyl), an arylcarbonyl group (preferably having from 7 to 80 carbon atoms, for example, benzoyl or alkylbenzoyl) or an acyloxy group (preferably having from 2 to 80 carbon atoms, for example, acetyloxy, propionyloxy or butyroyloxy).

Hammett's rule regarding Hammett substituent constant to argue quantitatively influence of substituents on reaction of a benzene derivative or the equilibrium was advocated by L. P. Hammett in 1935 and has been accepted widely. The substituent constant obtained according to the Hammett rule include $\sigma_p$ value and $\sigma_m$ value. These values are described in many documents such as J. A. Dean, *Lange's Handbook of Chemistry*, Vol. 12 (1979) (McGraw-Hill) and "*Kagaku no Ryouiki Zoukan (Additional Version of Chemistry Region)*", Vol. 122, pp. 96–103 (1979) (by Nankoudou), and *Chemical Reviews*, Vol. 91, pp. 165–195 (1991). The substituents defined by the range of the Hammett's constant in the present invention include not only those disclosed in these known documents but also those not being disclosed in the documents but having the Hammett's constant (obtained by measurement) falling within the defined range.

σ values of the typical substituents are shown below: bromine atom ($\sigma_m$=0.39, $\sigma_p$=0.23), chlorine atom ($\sigma_m$=0.37, $\sigma_p$=0.23), cyano group ($\sigma_m$=0.56, $\sigma_p$=0.66), nitro group ($\sigma_m$=0.71, $\sigma_p$=0.78), trifluoromethyl group ($\sigma_m$=0.43, $\sigma_p$=0.54), tribromomethyl group ($\sigma_m$=0.28, $\sigma_p$=0.29), trichloromethyl group ($\sigma_m$=0.32, $\sigma_p$=0.33), carboxyl group ($\sigma_m$=0.37, $\sigma_p$=0.45), acetyl group ($\sigma_m$=0.38, $\sigma_p$=0.50), benzoyl group ($\sigma_m$=0.34, $\sigma_p$=0.43), acetyloxy group ($\sigma_m$=0.39, $\sigma_p$=0.31), trifluoromethanesulfonyl group ($\sigma_m$=0.79, $\sigma_p$=0.93), methanesulfonyl group ($\sigma_m$=0.60, $\sigma_p$=0.72), benzenesulfonyl group ($\sigma_m$ =0.61, $\sigma_p$=0.70), methanesulfinyl group ($\sigma_m$=0.52, $\sigma_p$=0.49), carbamoyl group ($\sigma_m$=0.35, $\sigma_p$=0.36), methylcarbamoyl group ($\sigma_m$=0.35, $\sigma_p$=0.36), methoxycarbonyl group ($\sigma_m$=0.37, $\sigma_p$=0.45), ethoxycarbonyl group ($\sigma_m$=0.37, $\sigma_p$=0.45), phenoxycarbonyl group ($\sigma_m$=0.37, $\sigma_p$=0.44), 1-pyrrolyl group ($\sigma_m$=0.47, $\sigma_p$=0.37), methanesulfonyloxy group ($\sigma_m$=0.39, $\sigma_p$=0.36), diethoxyphosphoryl group ($\sigma_m$=0.55, $\sigma_p$=0.60), sulfamoyl group ($\sigma_m$=0.46, $\sigma_p$=0.57), methyl group ($\sigma_m$=−0.07, $\sigma_p$=−0.17), amino group ($\sigma_m$=−0.16, $\sigma_p$=−0.66), ureido group ($\sigma_m$=−0.03, $\sigma_p$=−0.24), methanesulfonamide group ($\sigma_m$=0.20, $\sigma_p$=0.03) and acetylamino group ($\sigma_m$=0.21, $\sigma_p$=0.00).

$R_2$ and $R_4$ each is preferably a hydrogen atom. Further, the sum of the Hammett constants $\sigma_p$ of $R_1$ to $R_3$ is preferably 0 or more. It is preferred that $R_1$ and $R_3$ each is a substituent (other than a hydrogen atom) such that the sum of the Hammett constants $\sigma_p$ of $R_1$ and $R_3$ is 0 or more. Either of $R_1$ and $R_3$ is preferably an electron-withdrawing group having a Hammett constant $\sigma_p$ of 0.20 to 1.0 (preferred examples thereof include a halogen atom, a carbamoyl group, a sulfamoyl group, an alkoxycarbonyl group, an acyl group, and a cyano group).

$R_5$ to $R_9$ each represents a hydrogen atom or a substituent similarly to $R_1$ to $R_4$, and at least either of $R_5$ and $R_9$ is a substituent (i.e., a group other than a hydrogen atom). $R_1$ and $R_2$, $R_5$ and $R_6$, $R_6$ and $R_7$, $R_7$ and $R_8$, or $R_8$ and $R_9$ may combine with each other to form a ring.

Examples of $R_5$ to $R_9$ include a hydrogen atom, a halogen atom, an amino group, an alkyl group, an aryl group, an acylamino group, an alkylcarbonamido group, an arylcarbonamido group, a sulfonamido group (e.g., alkylsulfonamido, arylsufonamido), an aryloxy group, an alkylthio group, an arylthio group, an alkyl-carbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, an acyloxy group, a heterocyclic group, an alkoxycarbonylamino group, an aryloxycarbonylamino group, an ureido group, a phosphorylamino group, and a carbamoyloxy group. In particular, $R_5$ and/or $R_9$ is a substituent.

In particular, examples of $R_5$ to $R_9$ include a hydrogen atom, a halogen atom (for example, chlorine and bromine), an amino group (preferably having from 0 to 80 carbon atoms, for example, amino, dimethylamino, and diethylamino), an alkyl group (preferably having from 1 to 80 carbon atoms, for example, methyl, ethyl, isopropyl, n-butyl and t-butyl), an aryl group (preferably having from 6 to 80 carbon atoms, for example, phenyl, tolyl and xylyl), an alkylcarbonamido group (preferably having from 2 to 80 carbon atoms, for example, acetylamino, propionylamino and butyroylamino), an arylcarbonamido group (preferably having from 7 to 80 carbon atoms, for example, benzoylamino), an alkyl-sulfonamido group (preferably having from 1 to 80 carbon atoms, for example, methanesulfonylamino and ethanesulfonylamino), an arylsulfonamido group (preferably having from 6 to 80 carbon atoms, for example, benzenesulfonylamino and toluenesulfonylamino), an aryloxy group (preferably having from 6 to 80 carbon atoms, for example, phenoxy), an alkylthio group (preferably having from 1 to 80 carbon atoms, for example, methylthio, ethylthio, and butylthio), an arylthio group (preferably having from 6 to 80 carbon atoms, for example, phenylthio and tolylthio), an alkylcarbamoyl group (preferably having from 2 to 80 carbon atoms, for example, methylcarbamoyl, dimethylcarbamoyl, ethylcarbamoyl, diethylcarbamoyl, dibutylcarbamoyl, piperidylcarbamoyl and morpholylcarbamoyl), an arylcarbamoyl group (preferably having from 7 to 80 carbon atoms, for example, phenylcarbamoyl, methylphenylcarbamoyl, ethylphenylcarbamoyl and benzylphenylcarbamoyl), a carbamoyl group, an alkylsulfamoyl group (preferably having from 1 to 80 carbon atoms, for example, methylsulfamoyl, dimethylsulfamoyl, ethylsulfamoyl, diethylsulfamoyl, dibutylsulfamoyl, piperidylsulfamoyl and morpholylsulfamoyl), an arylsulfamoyl group (preferably having from 6 to 80 carbon atoms, for example, phenylsulfamoyl, methylphenylsulfamoyl, ethylphenylsulfamoyl and benzylphenylsulfamoyl), a sulfamoyl group, a cyano group, an alkylsulfonyl group (preferably having from 1 to 80 carbon atoms, for example, methanesulfonyl and ethanesulfonyl), an arylsulfonyl group (preferably having from 6 to 80 carbon atoms, for example, phenylsulfonyl, 4-chlorophenylsulfonyl and p-toluenesulfonyl), an alkoxycarbonyl group (preferably having from 2 to 80 carbon atoms, for example, methoxycarbonyl, ethoxycarbonyl and butoxycarbonyl), an aryloxycarbonyl group (preferably having from 7 to 80 carbon atoms, for example, phenoxycarbonyl), an alkylcarbonyl group (preferably having from 2 to 80 carbon atoms, for example, acetyl, propionyl and butyroyl), an arylcarbonyl group (preferably having from 7 to 80 carbon atoms, for example, benzoyl and alkylbenzoyl), an acyloxy group (preferably having from 2 to 80 carbon atoms, for example, acetyloxy, propionyloxy and butyroyloxy), a heterocyclic group (preferably having from 1 to 80 carbon atoms, for example, pyridyl and pyrimidyl), an alkoxycarbonylamino group (preferably having from 2 to 80 carbon atoms, for example, methoxycarbonylamino and ethoxycarbonylamino), an aryloxycarbonylamino group (preferably having from 7 to 80 carbon atoms, for example, phenoxycarbonylamino), an ureido group (preferably having from 1 to 80 carbon atoms, for example, N,N-dimethylureido), a phosphorylamino group (preferably having from 2 to 80 carbon atoms, for example, dimethylphosphorylamino, diphenyl-phosphorylamino and diethoxyphosphorylamino), and a carbamoyloxy group (preferably having from 1 to 80 carbon atoms, for example, dimethylcarbamoyloxy and diethylcarbamoyloxy).

$R_1$ and $R_2$, $R_5$ and $R_6$, $R_6$ and $R_7$, $R_7$ and $R_8$, or $R_8$ and $R_9$ may combine with each other to form a ring (for example, a naphthalene ring, a tetralin ring or a coumarin ring).

It is preferred that the sum of the Hammett constants $\sigma$ values of $R_5$ to $R_9$ amounts to 0 or less. With respect to the Hammett constant $\sigma$ value of $R_7$, $\sigma_p$ can be used, and with respect to the Hammett constant $\sigma$ values of $R_6$ and $R_8$, $\sigma_m$ can be used. With respect to the Hammett constant $\sigma$ values of $R_5$ and $R_9$, $\sigma_p$ can be used instead. $R_5$ and/or $R_9$ each is preferably a halogen atom, an amino group, an alkyl group, an aryl group, an acylamino group, a sulfonamido group, an alkoxycarbonylamino group, an aryloxycarbonylamino group, an ureido group, a phosphorylamino group, an alkoxycarbonyl group, an aryloxycarbonyl group, an alkylsulfonyl group, an arylsulfonyl group, an acyloxy group and a carbamoyl group, and more preferably an alkyl group, an aryl group, an acylamino group and a sulfonamido group, and most preferably an alkyl group.

The compounds represented by formula (1) are preferably oil-soluble compounds in order to use for the purpose of the present invention. It is therefore preferable for the compound to contain at least one group having ballasting properties. The ballasting group as used herein means an oil-solubilizing group, which is a group with an oil-soluble moiety having generally from 8 to 80 carbon atoms, preferably from 8 to 40, and more preferably from 10 to 40 carbon atoms. It is therefore preferred that $R_1$ to $R_4$, preferably $R_1$ to $R_3$, contain a ballasting group having 8 or more carbon atoms or the total carbon number of $R_5$ to $R_9$ is 8 or more. The carbon number is preferably from 8 to 80, and more preferably from 8 to 20.

The developing agent represented by formula (1)added by added by the following method. First, a coupler, the developing agent and a high boiling organic solvent (for example, alkyl phosphates and alkyl phthalates) are mixed, and the mixture is dissolved in a low boiling organic solvent (for example, ethyl acetate and methyl ethyl ketone). The resulting solution is dispersed in water by any emulsion dispersing method known in the art, followed by addition. Further, it is also possible to add them by the solid dispersion method described in JP-A-63-271339. As described above, the compound of formula (1) can be incorporated into a photographic material, especially a heat developable photosensitive material, but is also useful for a photographic material to be subjected to wet processing where an usual solution treatment is conducted.

The amount of the developing agent represented by formula (1) to be added vary over a wide range when the developing agent is used with coupler(s), but the developing agent is preferably added in a 0.01- to 100-fold molar amount in relation to the coupler, and more preferably in a 0.1- to 10-fold molar amount, and as the amount of the developing agent per square meter of the photographic material, it is preferably 0.01 to 1000 mmol/m2, more preferably from 0.1 to 50 mmol/$m^2$.

Synthesis of Developing Agent D-1

Developing agent D-1 was synthesized by a synthesis route according to the following scheme-1.

Scheme-1

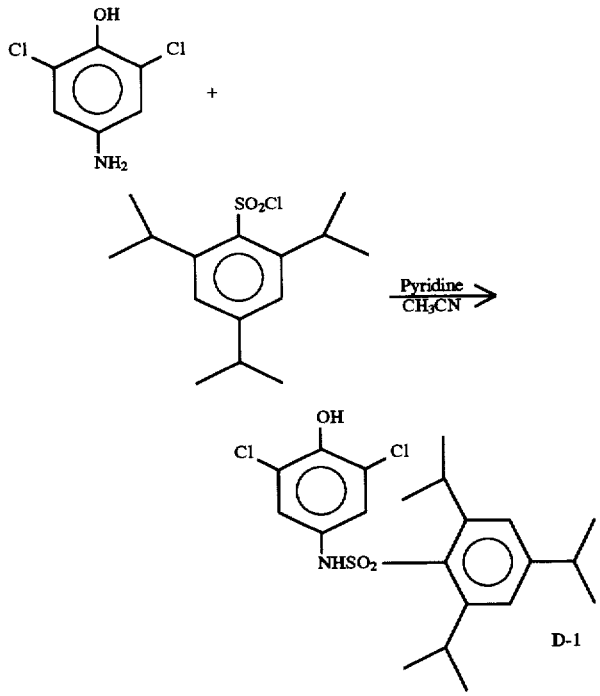

In a 2-liter three-necked flask equipped with a condenser and a thermometer, 800 ml of acetonitrile and 214 g (1.2 moles) of 2,6-dichloro-4-aminophenol were placed, and maintained at 0° C. or less on a methanol-ice bath with stirring. When 81 ml (1 mole) of pyridine was added thereto in a stream of nitrogen, the mixture became homogeneous while emitting heat. With the resulting solution maintained at 5° C. or less, 303 g (1 mole) of 2,4,6-triisopropylbenzenesulfonyl chloride was added thereto over a 1-hour period with caution so that the temperature inside the flask did not exceed 10° C. After the termination of addition, the mixture was further stirred for 1 hour at 10° C. or less to achieve the reaction. Then, the ice bath was removed, and the resulting mixture was furthermore stirred for 1 hour at room temperature. The reactiou mixture was poured into 10 liters of a 0.1N ice-aqueous solution of hydrochloric acid, and precipitated crystals were filtered off. The crude crystals were recrystallized from 2 liters of methanol to obtain 404 g of developing agent D-1 as crystals (yield: 91%).

Synthesis of Developing Agent D-7

Developing agent D-7 was synthesized by a synthesis route according to the following scheme-2.

Scheme-2

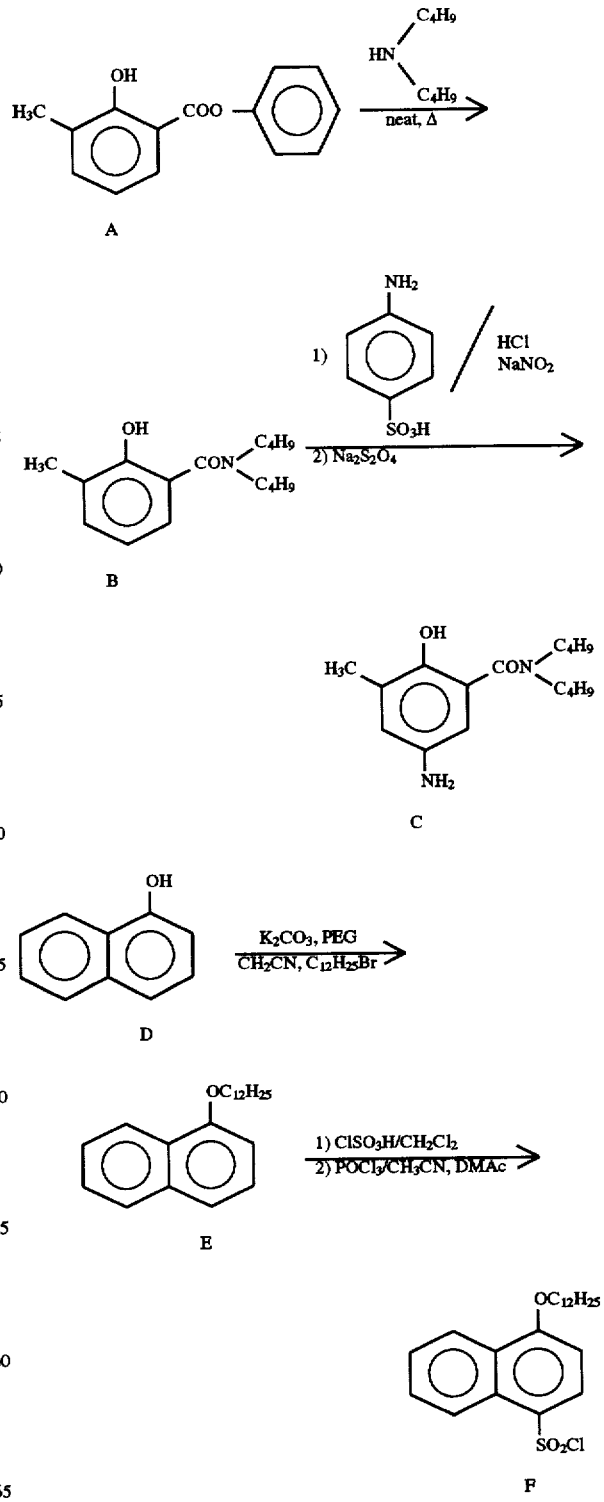

-continued

Scheme-2

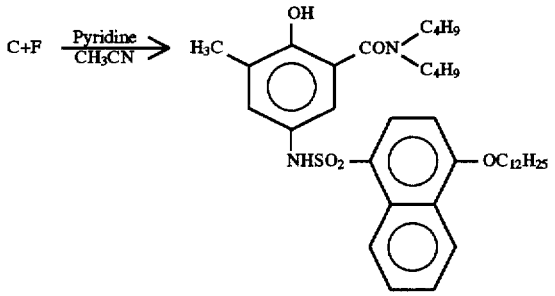

1) Synthesis of Compound B from Compound A

A rotor for a magnetic stirrer, 228 g (1 mole) of compound A, and 155 g (1.2 moles) of di-n-butylamine were placed in a 1-liter egg-plant type flask, which was then equipped with a gas-introducing tube connected to an aspirator through a pressure rubber tube. The mixture was stirred with the magnetic stirrer while keeping reduced pressure by a stream of water, and the temperature was raised to 120° C. Then, crystallized phenol was observed inside the glass portion of the aspirator. The reaction was further continued as such for 4 hours, and when the deposition of phenol was not observed, the temperature was lowered to room temperature. The reaction mixture was poured into 3 liters of an aqueous solution of hydrochloric acid. Precipitated crystals were filtered off, and the crude crystals were recrystallized from 1 liter of methanol to obtain 242 g of compound B as crystals (yield: 92%).

2) Synthesis of Compound C from Compound B

In a 5-liter beaker, 66 g (0.25 mole) of compound B was placed, and subsequently, 100 ml of methanol, 250 g (1.8 moles) of potassium carbonate and 500 ml of water were added thereto and completely dissolved. The resulting solution was stirred while maintaining the temperature at 0° C. or less. On the other hand, 65 g (0.375 mole) of sulfanilic acid was completely dissolved in a solution in which 16.5 g of sodium hydroxide was dissolved in 30 ml of water. Then, 90 ml of concentrated hydrochloric acid was added thereto to prepare a slurry-like solution. This solution was vigorously stirred while maintaining the temperature at 0° C. or less, and a solution of 27.5 g (0.4 mole) of sodium nitrite in 50 ml of water was gradually added thereto to form a diazonium salt. At this time, the reaction was conducted while appropriately adding ice so as to maintain the temperature at 0° C. or less. The diazonium salt thus prepared was gradually added to the solution of compound B which had been stirred for some time. In this case, the reaction was also conducted while appropriately adding ice so as to maintain the temperature at 0° C. or less. With the addition, the solution showed a red color of an azo dye. After the termination of addition, the reaction was further continued at 0° C. or less for 30 minutes. After disappearance of the starting material was confirmed, 500 g (3 moles) of sodium hydrosulfite was added in the powder form to the reaction mixture. When the solution was heated to 50° C., the reduction of the azo group started while foaming violently. When foaming was ceased and the solution was decolorized to a yellowish transparent solution, this solution was cooled to 10° C. to precipitate crystals. The precipitated crystals were filtered off, and the crude crystals were recrystallized from 300 ml of methanol to obtain 56 g of compound C as crystals (yield: 80%).

3) Synthesis of Compound E from Compound D

In a 5-liter three-necked flask equipped with a condenser, 1500 ml of acetonitrile, 300 ml of polyethylene glycol (polymerization degree: 400), 360 g (2.5 moles) of 1-naphthol, 498 g (2 moles) of lauryl bromide and 345 g (2.5 moles) of potassium carbonate were placed, and refluxed in a steam bath for 4 hours. After cooling, the reaction mixture was extracted twice with 700 ml of n-hexane, and hexane layers were collected. The collected layers were washed with 0.1N aqueous sodium hydroxide, water and subsequently saturated saline, followed by drying over anhydrous magnesium sulfate. n-Hexane was removed by distillation from this solution under reduced pressure to obtain 613 g of oily compound E (yield: 98%).

4) Synthesis of Compound F from Compound E

In a 3-liter three-necked flask equipped with a condenser, 1.2 liters of dichloromethane and 312.5 g (1 mole) of compound E were placed, and the inner temperature was maintained at 0° C. or less with stirring by use of a methanol-ice bath. Chlorosulfonic acid was dropwise added thereto in an amount of 116.5 g (1 mole) over an 1-hour period. At this time, the inner temperature was kept at 10° C. or less. After the dropwise addition, the methanol-ice bath was removed, and the reaction was further continued at room temperature for 2 hours. The reaction mixture was transferred to a egg-plant type flask, and dichloromethane was removed by distillation under reduced pressure to obtain a slurry containing crystals. The resulting slurry was then transferred to a 3-liter three-necked flask equipped with a condenser. Addition of 1 liter of acetonitrile and 400 ml of N,N-dimethylacetamide thereto raised the inner temperature to about 40° C. Then, 184 g (1.2 moles) of phosphorous oxychloride was added thereto over a 5-minute period with well stirring. At this time, the inner temperature was raised to 55° C., and therefore, the reaction was further continued as such for 1 hour. When the temperature of the reaction mixture dropped to 25° C., the mixture was poured into 10 liters of ice water to precipitate crystals. The precipitated crystals were filtered off and the crude crystals were recrystallized from 1 liter of acetonitrile to obtain 350 g of compound F as crystals (yield: 85%). 5) Synthesis of Developing Agent D-7 from Compounds C and F In a 2-liter three-necked flask equipped with a condenser and a thermometer, 700 g of acetonitrile, 139 g (0.5 mole) of compound C, and 206 g (0.5 mole) of compound F were placed, and stirred in a stream of nitrogen at room temperature. To the mixture, 40 g (0.5 mole) of pyridine was added dropwise over a 1-hour period. At this time, the temperature was adjusted so as not to exceed 30° C. After the completion of dropwise addition, the mixture was further stirred for 2 hours, and poured into 5 liters of a chilled aqueous solution of hydrochloric acid. When crystals were precipitated, the crystals were filtered off and recrystallized from 800 ml of methanol to obtain 352 g of developing agent D-7 as crystals (yield: 92%).

Examples of the compounds represented by formula (1) are shown below, but the compounds used in the present invention are not, of course, limited thereby.

D-1

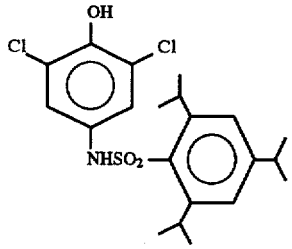

-continued
D-2
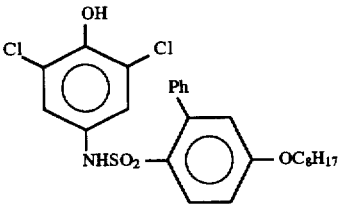
hereinafter Ph = 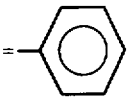
D-3
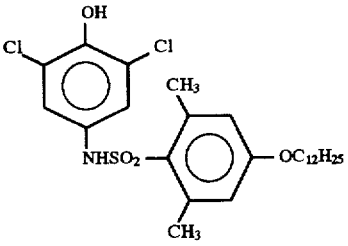
D-4
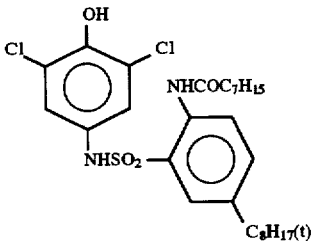
D-5
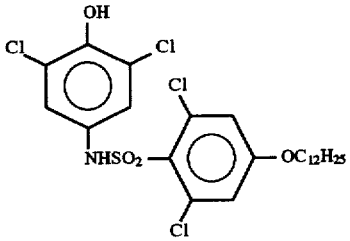
D-6
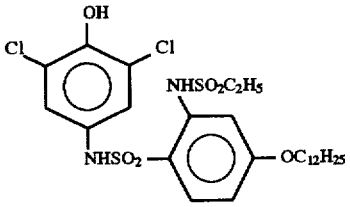
D-7
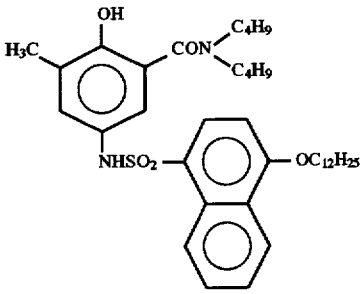
-continued
D-8
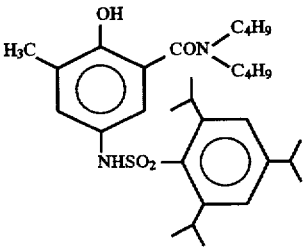
D-9
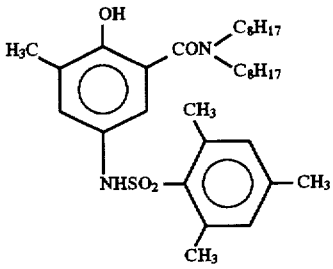
D-10
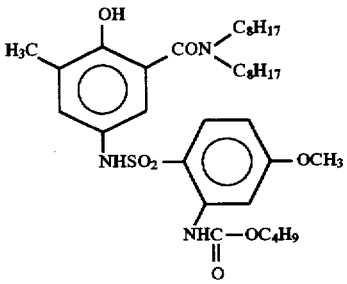
D-11
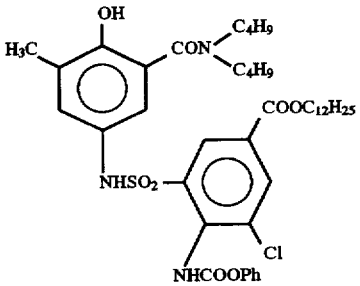
D-12
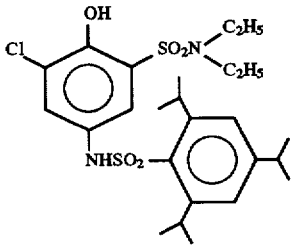
D-13
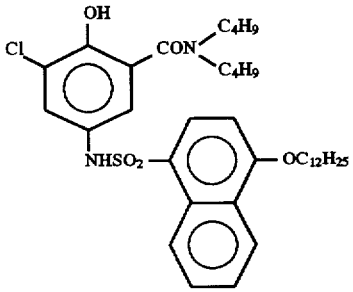

-continued
D-14
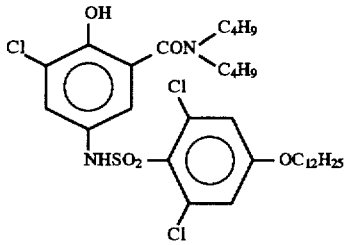
D-15
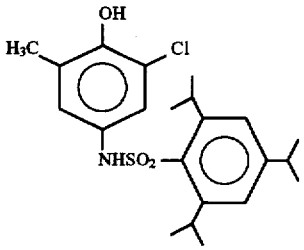
D-16
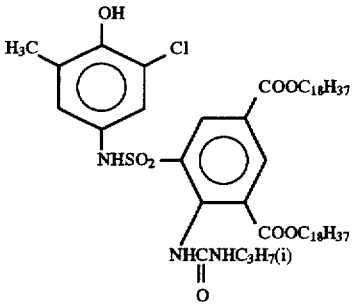
D-17
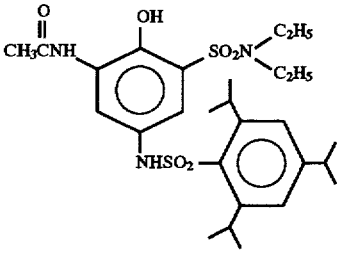
D-18
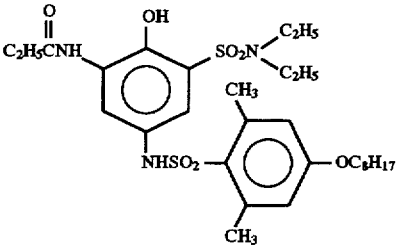
D-19
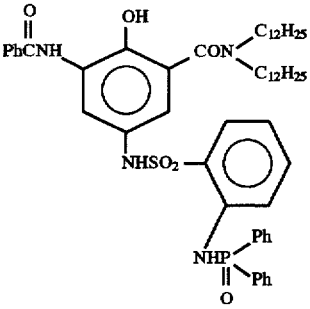
-continued
D-20
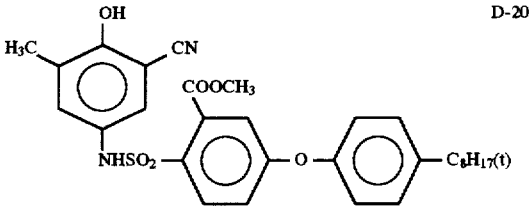
D-21
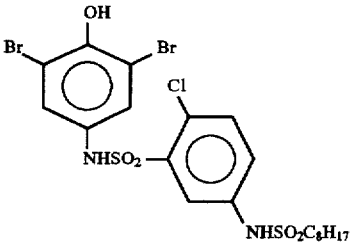
D-22
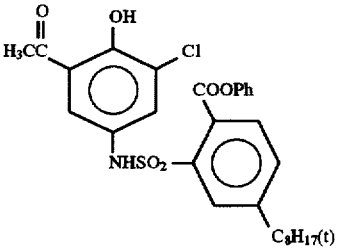
D-23
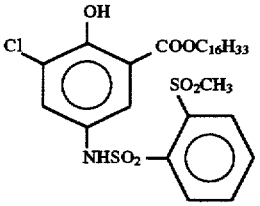
D-24
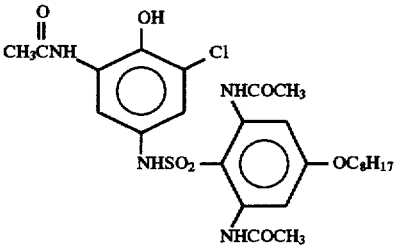
D-25
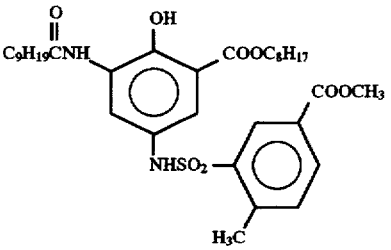

-continued

D-26

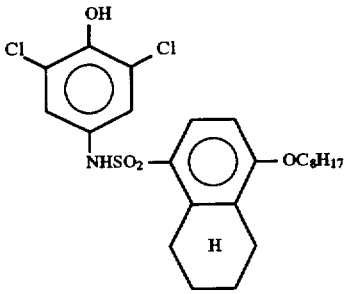

D-27

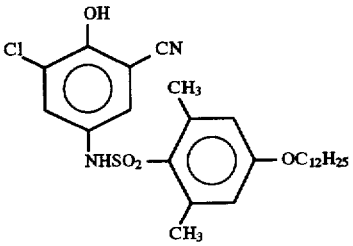

D-28

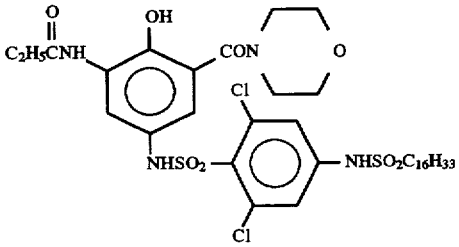

D-29

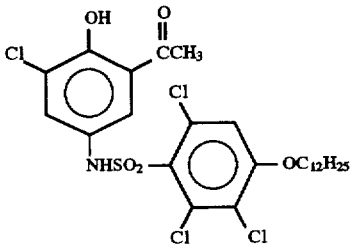

D-30

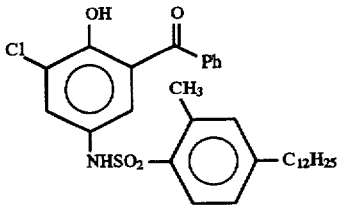

D-31

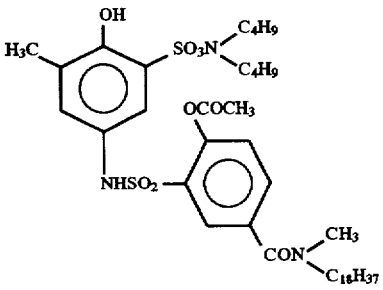

-continued

D-32

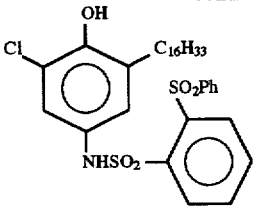

D-33

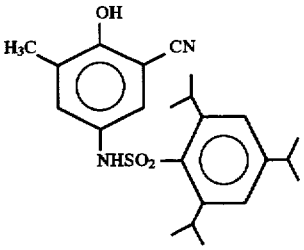

D-34

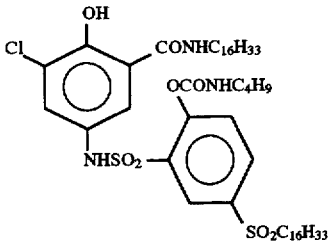

D-35

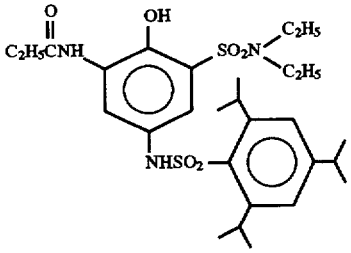

In the present invention, a compound (coupler) which forms a dye by the oxidation coupling reaction is used as a dye donating compound. Although the coupler may be either a 4-equivalent coupler or a 2-equivalent coupler, the 4-equivalent coupler is preferably employed in the present invention. The reason for this is that first, an amino group, a coupling site of a reducing agent, is blocked by a substituent, and when the coupling site on the coupler side has the substituent, the reaction is inhibited by steric hindrance, and that second, the substituent is released as an anion after coupling, so that the releasing group on the coupler side must be released as a cation, and customary 2-equivalent couplers can not form such releasing groups.

Examples of both the 4-equivalent and 2-equivalent couplers are described in detail in *Theory of the Photographic Process*, 4th ed., edited by T. H. James, pages 291 to 334 and 354 to 361, Macmillan, 1977, JP-A-58-12353, JP-A-58-149046, JP-A-58-149047, JP-A-59-11114, JP-A-59-124399, JP-A-59-174835, JP-A-59-231539, JP-A-59-231540, JP-A-60-2951, JP-A-60-14242, JP-A-60-23474 and JP-A-60-66249.

Preferred examples of the coupler used in the present invention are enumerated below.

Compounds having structures as represented by the following formulas (2) to (13) are preferably used as the couplers in the present invention. These are compounds which are generally named active methylene, pyrazolone, pyrazoloazole, phenol, naphthol and pyrrolotriazole, respectively, and are well known in the art.

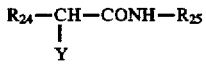

(2)

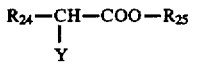

(3)

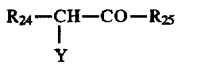

(4)

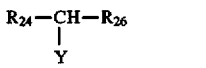

(5)

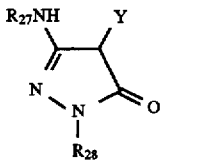

(6)

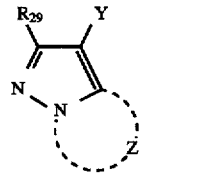

(7)

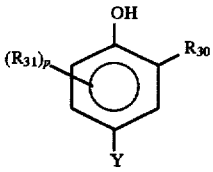

(8)

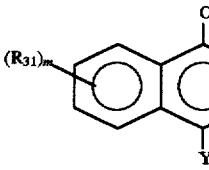

(9)

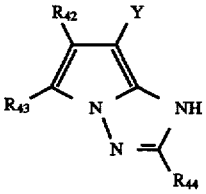

(10)

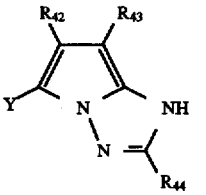

(11)

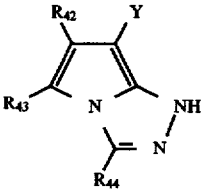

(12)

-continued

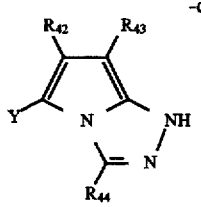

(13)

Formulas (2) to (5) indicate couplers referred to as active methylene couplers, wherein $R_{24}$ is an acyl group, a cyano group, a nitro group, an aryl group, a heterocyclic group, an alkoxycarbonyl group, an aryloxycarbonyl group, a carbamoyl group, a sulfamoyl group, an alkylsulfonyl group or an arylsulfonyl group, which may have a substituent.

In formulas (2) to (5), $R_{25}$ is an alkyl group, an aryl group or a heterocyclic group, which may have a substituent. In formula (5), $R_{26}$ is an aryl group or a heterocyclic group, which may have a substituent. The substituents which $R_{24}$, $R_{25}$ and $R_{26}$ may have include various substituent such as alkyl, alkenyl, alkynyl, aryl, heterocyclic, alkoxyl, aryloxy, cyano, halogen atom, acylamino, sulfonamido, carbamoyl, sulfamoyl, alkoxycarbonyl, aryloxycarbonyl, alkylamino, arylamino, hydroxyl and sulfo group. Preferred examples of $R_{24}$ include acyl, cyano, carbamoyl and alkoxycarbonyl groups.

In formulas (2) to (5), Y is a hydrogen atom or a group which is removable by the coupling reaction with an oxidized product of a developing agent. Examples of the group represented by Y include a carboxyl group, a formyl group, a halogen atom (for example, chlorine and bromine), a carbamoyl group, a methylene group having substituent(s) (the substituent includes aryl, sulfamoyl, carbamoyl, alkoxyl, amino and hydroxyl), an acyl group and a sulfo group. Of these, Y is preferably a hydrogen atom as described above.

In formulas (2) to (5), $R_{24}$ and $R_{25}$, or $R_{24}$ and $R_{26}$ may be combined with each other to form a ring.

Formula (6) represents couplers called 5-pyrazolone magenta couplers. In formula (6), $R_{27}$ represents an alkyl group, an aryl group, an acyl group or a carbamoyl group. $R_{28}$ represents a phenyl group or a phenyl group having at least one halogen atom, alkyl, cyano, alkoxyl, alkoxycarbonyl or acylamino group as a substituent. Y has the same meaning as in formulas (2) to (5).

Of the 5-pyrazolone magenta couplers represented by formula (6), couplers are preferred in which $R_{27}$ is an aryl group or an acyl group, $R_{28}$ is a phenyl group having at least one halogen atom as a substituent, and Y is a hydrogen atom.

These preferred groups are described in detail. $R_{27}$ is an aryl group such as phenyl, 2-chlorophenyl, 2-methoxyphenyl, 2-chloro-5-tetradecaneamidophenyl, 2-chloro-5-(3-octadecenyl-1-succinimido)phenyl, 2-chloro-5-octadecylsulfon-amidophenyl or 2-chloro-5-[2-(4-hydroxy-3-t-butylphenoxy)-tetradecaneamido]phenyl, or an acyl group such as acetyl, pivaloyl, tetradecanoyl, 2-(2,4-di-t-pentylphenoxy)acetyl, 2-(2,4-di-t-pentylphenoxy) butanoyl, benzoyl or 3-(2,4-di-t-amylphenoxyacetazido) benzoyl. These groups may further have substituent(s), which is an organic substituent linked through a carbon atom, a oxygen atom, a nitrogen atom or a sulfur atom, or a halogen atom.

$R_{28}$ is preferably a substituted phenyl group such as 2,4,6-trichlorophenyl, 2,5-dichlorophenyl or 2-chlorophenyl.

Formula (7) represents couplers called pyrazoloazole couplers. In formula (7), $R_{29}$ represents a hydrogen atom or a substituent. Z represents a group of nonmetalic atoms necessary for forming a 5-membered azole ring containing 2 to 4 nitrogen atoms, and the azole ring may have a substituent (including a condensed ring). Y has the same meaning as in formulas (2) to (5).

Of the pyrazoloazole couplers represented by formula (7), imidazo[1,2-h]pyrazoles described in U.S. Pat. No. 4,500,630, pyrazolo[1,5-b][1,2,4]triazoles described in U.S. Pat. No. 450,654 and pyrazolo[5,1-c][1,2,4]triazoles described in U.S. Pat. No. 3,725,067 are preferred in respect to absorption characteristics of color developing dyes. Of these, pyrazolo[1,5-b][1,2,4]triazoles are preferred in respect to light fastness.

Details of the substituent for the azole ring represented by $R_{29}$, Y and Z are described, e.g., in U.S. Pat. No. 4,540,654, the second column, line 41 to the eighth column, line 27. Preferred examples thereof include pyrazoloazole couplers in each of which a branched alkyl group is directly connected to the 2-, 3- or 6-position of a pyrazolotriazole ring as described in JP-A-61-65245, pyrazoloazole couplers containing a sulfonamido group in their molecules described in JP-A-61-65245, pyrazoloazole couplers having alkoxyphenyl-sulfonamido ballast groups described in JP-A-6-147254, pyrazolotriazole couplers each having an alkoxyl group or an aryloxy group at the 6-position described in JP-A-62-209457 or JP-A-63-307453, and pyrazolotriazole couplers having carbonamido groups in their molecules described in JP-A-2-201443.

Formulas (8) and (9) represent couplers called phenol couplers and naphthol couplers, respectively. In formulas (8) and (9), $R_{30}$ represents a hydrogen atom or a group selected from the group consisting of $—NHCOR_{32}$, $—SO_2NR_{32}R_{33}$, $—NHSO_2R_{32}$, $—NHCOR_{32}$, $—NHCONR_{32}R_{33}$ and $—NHSO_2NR_{32}R_{33}$. $R_{32}$ and $R_{33}$ each represents a hydrogen atom or a substituent. In formulas (8) and (9), $R_{31}$ represents a substituent, p represents an integer of 0 to 2, and m is an integer of 0 to 4. Y has the same meaning as in formulas (2) to (5). Examples of the groups represented by to $R_{33}$ include the substituents for $R_{24}$ to $R_{26}$ described above.

Preferred examples of the phenol couplers represented by formula (8) include 2-alkylamino-5-alkylphenol couplers described in U.S. Pat. Nos. 2,369,929, 2,801,171, 2,772,162, 2,895,826 and 3,772,002, 2,5-diacylaminophenol couplers described in U.S. Pat. Nos. 2,772,162, 3,758,308, 4,126,396, 4,334,011 and 4,327,173, West German Patent (OLS) 3,329,729 and JP-A-59-166956, and 2-phenylureido-5-acylaminophenol couplers described in U.S. Pat. Nos. 3,446,622, 4,333,999, 4,451,559 and 4,427,767.

Preferred examples of the naphthol couplers represented by formula (9) include 2-carbamoyl-1-naphthol couplers described in U.S. Pat. Nos. 2,474,293, 4,052,212, 4,146,396, 4,228,233 and 4,296,200, and 2-carbamoyl-5-amido-1-naphthol couplers described in U.S. Pat. No. 4,690,889.

Formulas (10) to (13) represent couplers called pyrrolotriazole couplers. In formulas (10) to (13), $R_{42}$, $R_{43}$ and $R_{44}$ each represents a hydrogen atom or a substituent. Y has the same meaning as in formulas (2) to (5). The groups represented by $R_{42}$, $R_{43}$ and $R_{44}$ include the substituents for $R_{24}$ to $R_{26}$ described above. Preferred examples of the pyrrolotriazole couplers represented by formulas (10) to (13) include couplers in each of which at least one of $R_{42}$ and $R_{43}$ is an electron attractive group, which are described in European Patents 488,248A1, 491,197A1 and 545,300.

The compounds of formulae (10) to (13) are described in more detail below.

In formulae (10) to (13), $R_{42}$, $R_{43}$ or $R_{44}$ each represents a hydrogen atom or a substituent. Examples of the substituent include an alkyl group (for example, methyl, ethyl, t-butyl, or cyclohexyl), an alkenyl group (for example, vinyl or alkylvinyl), an alkynyl group (for example, phenylacetylene), an aryl group (for example, phenyl, tolyl, naphthyl, alkylphenyl, alkoxyphenyl or acylphenyl), a heterocyclic group (for example, pyridyl, furyl, morpholyl or piperidyl), an alkoxyl group (for example, methoxy, ethoxy, benzyloxy, or dodecyloxy), an aryloxy (for example, phenoxy or naphtyloxy), an alkylthio group (for example, methylthio or ethylthio), an arylthio group (for example, phenylthio or tolylthio), a cyano group, a halogen atom, am alkylsulfonyl group (for example, methanesulfonyl, ethanesulfonyl or octanesulfonyl), an arylsulfonyl group (for example, phenylsulfonyl, toluenesulfonyl, 3,5-dimethoxycarbonylphenylsufonyl), an alkylcarbonyl group (for example, acetyl, propionyl, pivaloyl), an arylcarbonyl group (for example, benzoyl or naphtylcarbonyl), an alkylcarbonamido group (for example, acetylamino group, 2-ethylhexanoylamino group or pivaloylamino, succinamido), an arylcarbonamido group (for example, benzoylamino or phthalimido), an alkylsulfonamide group (for example, methanesulfonamide, ethansulfonamide), an arylsulfonamide group (for example, benzenesulfonamide, toluenesulfonamide, naphtalenesulfonamide), a carbamoyl group, an alkylcarbamoyl group (for example, methylcarbamoyl, dimethylcarbamoyl, diethylcarbamoyl, ethylphenylcarbamoyl, piperidylcarbamoyl, or morpholylcarbamoyl), an arylcarbamoyl group (for example, phenylcarbamoyl), a sulfamoyl group, an alkylsulfamoyl group (for example, dimethylsulfamoyl, diethylsulfamoyl, dibutylsulfamoyl, pyrrolidylsulfamoyl, morpholylsulfamoyl), an alkoxycarbonyl group (for example, methoxycarbonyl, ethoxycarbonyl or 2,6-di-t-butyl-4-methyl-1-cyclohexyloxycarbonyl), an aryloxycarbonyl group (for example, phenoxycarbonyl or alkylphenoxycarbonyl), an alkylamino group (for example, dimethylamino, diethylamino, morpholyl or 2,2,6,6-tetramethylpiperidyl), an arylamino group (for example, N-methylanilino or N-ethyltoluidyl), a hydroxyl group and a sulfo group. These groups may be further substituted. It is preferred that $R_{42}$ and $R_{43}$ each is an electron-withdrawing group such that the sum of the Hammett's substituent constants $\sigma_p$ of $R_{42}$ and $R_{43}$ is 0 or more. $R_{44}$ is preferably an electron-donating group, more preferably an alkyl group (for example, methyl, ethyl, t-butyl or t-octyl) or an aryl group having substitutent(s) such that the sum of the Hammett's $\sigma$ values of the substituents is 0 or less (for example, 4-alkoxyphenyl, alkylphenyl, sulfonamidophenyl, or carbonamidophenyl).

Furthermore, Y represents a hydrogen atom or a group capable of leaving on the reaction with an oxidized product of a developing agent. Examples of Y include a carboxyl group, a formyl group, a halogen atom (for example, bromine or iodine), a carbamoyl group, a methylene group having a substituent (examples of the substituent include aryl, sulfamoyl, carbamoyl, alkoxyl, amino or hydroxyl), an acyl group, and a sulfo group. It is most preferred that Y is a hydrogen atom, since the sulfonamidophenol represented by formula (1) is used as a coupling developing agent. In the case where the sulfonamidophenol compound is used, sulfinic acid s released as an anion from the developing agent on the coupling reaction to form a dye, and therefore, the releasing group from a coupler must be a cation. The releasing group substituted with a conventional 2-equivalent coupler is an anion-releasing type. For this reason, the 4-equivalent couplers in which Y is a hydrogen atom are most preferred.

In addition, couplers having structures such as cyclocondensed phenol, imidazole, pyrrole, 3-hydroxypyridine, active methine, 5,5-cyclocondensed heterocycles and 5,6-cyclocondensed heterocycles can be used.

As the cyclocondensed phenol couplers, couplers described in U.S. Pat. Nos. 4,327,173, 4,564,586 and 4,904,575 can be used.

As the imidazole couplers, couplers described in U.S. Pat. Nos. 4,818,672 and 5,051,347 can be used.

As the pyrrole couplers, couplers described in JP-A-4-188137 and JP-A-190347 can be used.

As the 3-hydroxypyridine couplers, couplers described in JP-A-1-315736 can be used.

As the active methine couplers, couplers described in U.S. Pat. Nos. 5,104,783 and 5,162,196 can be used.

As the 5,5-cyclocondensed heterocyclic couplers, pyrrolopyrazole couplers described in U.S. Pat. No. 5,164,289 and pyrroloimidazole couplers described in JP-A-4-174429 can be used.

As the 5,6-cyclocondensed heterocyclic couplers, pyrazolopyrimidine couplers described in U.S. Pat. No. 4,950,585, pyrrolotriazine couplers described in JP-A-4-204730, and couplers described in European Patent 556,700 can be used.

In the present invention, besides the above-mentioned couplers, couplers can also be used which are described in West German Patents 3,819,051A and 3,823,049, U.S. Pat. Nos. 4,840,883, 5,024,930, 5,051,347 and 4,481,268, European Patents 304,856A2, 329,036, 354,549A2, 374,781A2, 379,110A2 and 386,930A1, JP-A-63-141055, JP-A-64-32260, JP-A-64-32261, JP-A-2-297547, JP-A-2-44340, JP-A-2-110555, JP-A-3-7938, JP-A-3-160440, JP-A-3-172839, JP-A-4-172447, JP-A-4-179949, JP-A-4-182645, JP-A-4-184437, JP-A-4-188138, JP-A-4-188139, JP-A-4-194847, JP-A-4-204532, JP-A-4-204731 and JP-A-4-204732.

Examples of the couplers which can be used in the present invention are shown below, but the present invention are not, of course, limited thereto.

Examples of Couplers

C-1

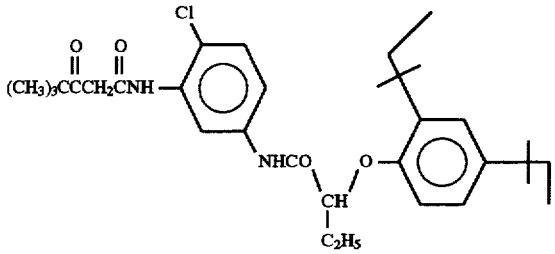

C-2

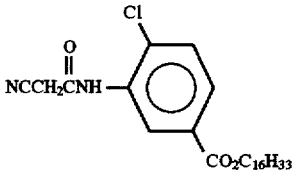

C-3

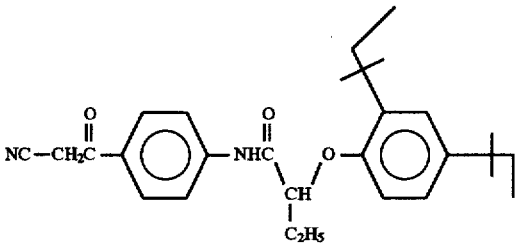

C-4

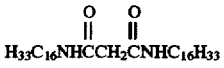

C-5

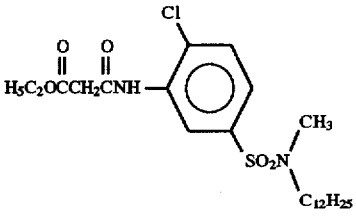

-continued
C-6
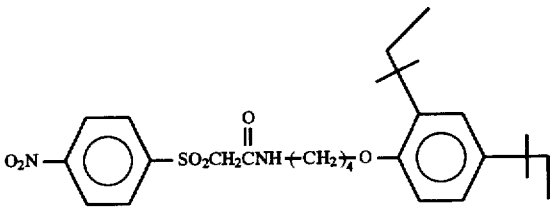
C-7
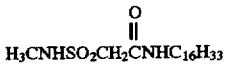
C-8
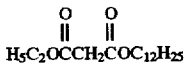
C-9
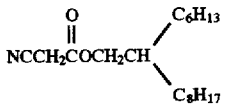
C-10
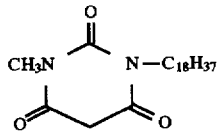
C-11
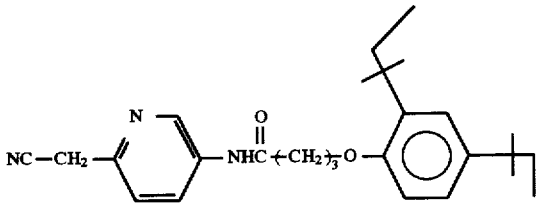
C-12
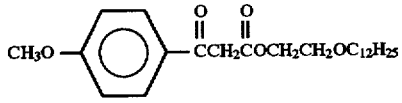
C-13
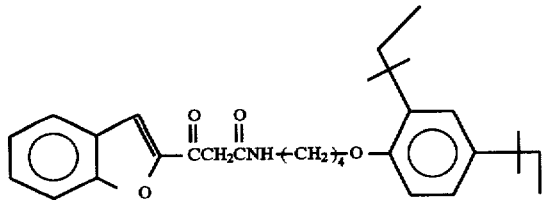
C-14
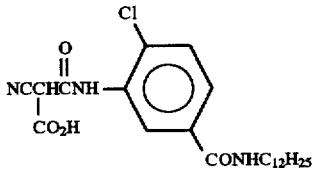
C-15
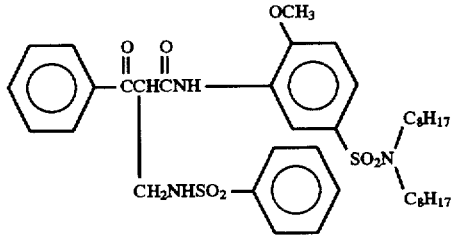

-continued
C-16
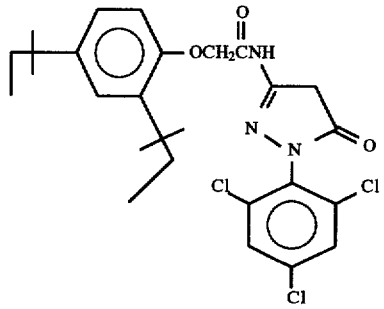
C-17
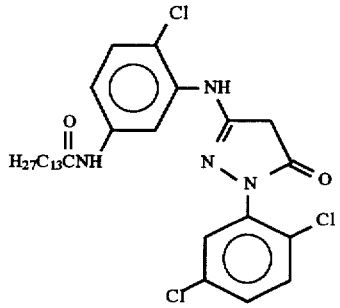
C-18
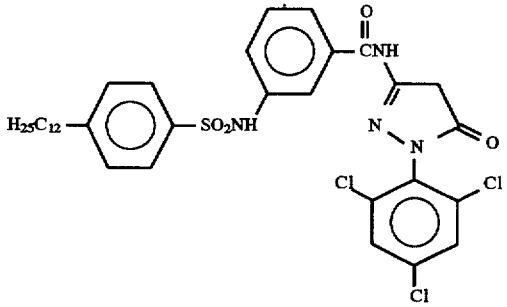
C-19
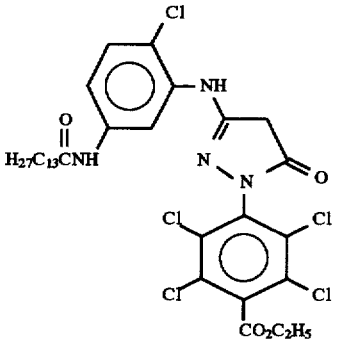
C-20
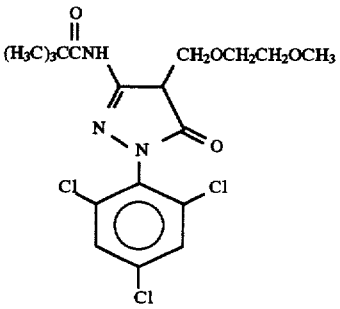

-continued
C-21
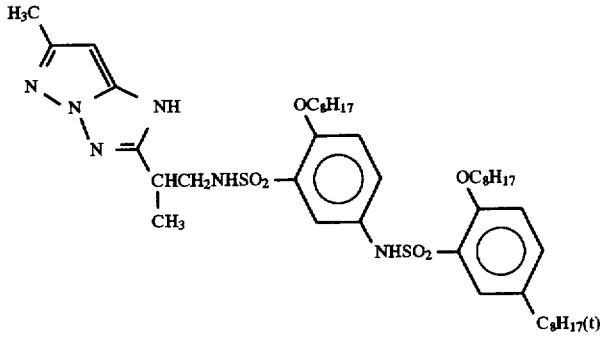
C-22
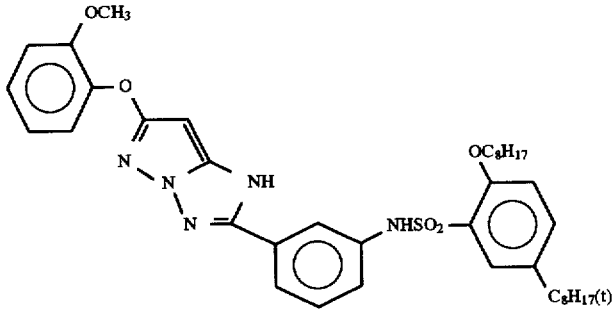
C-23
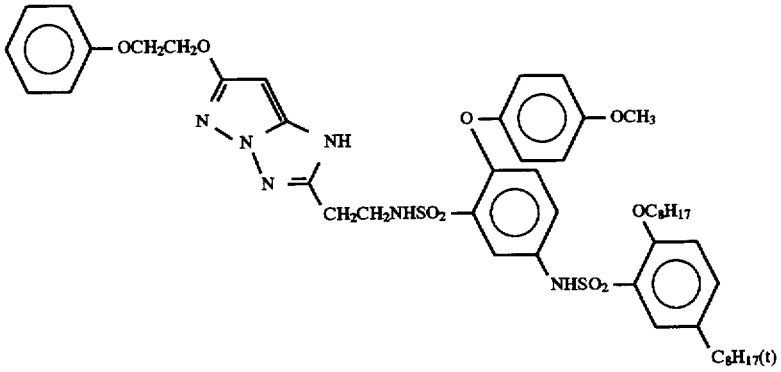
C-24
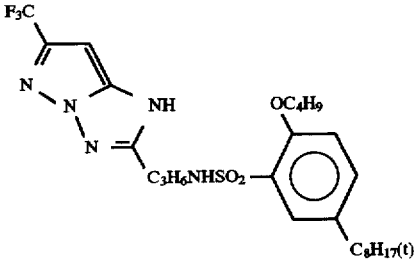
C-25
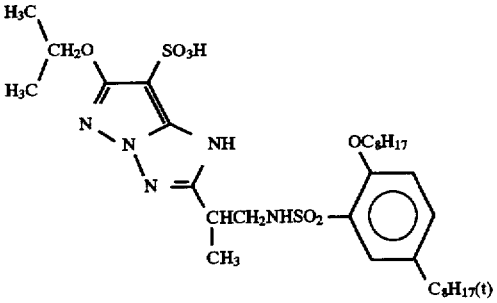

-continued
C-26
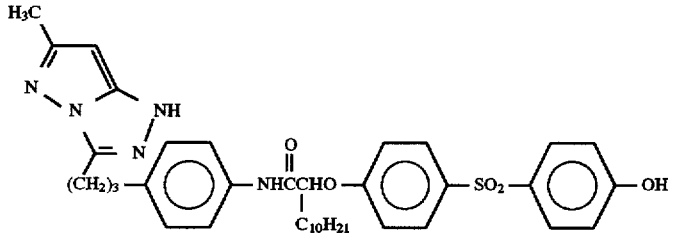
C-27
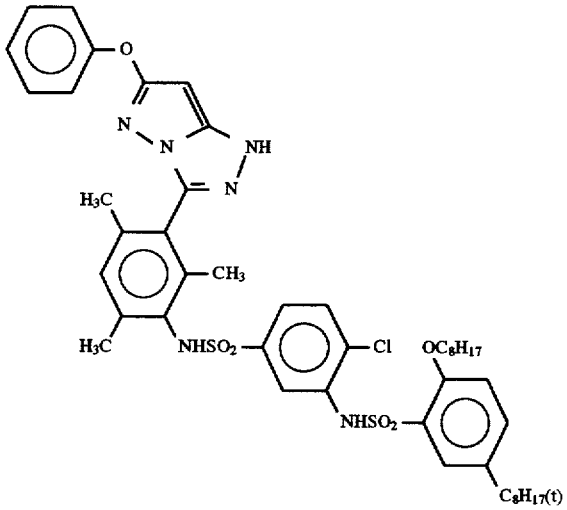
C-28
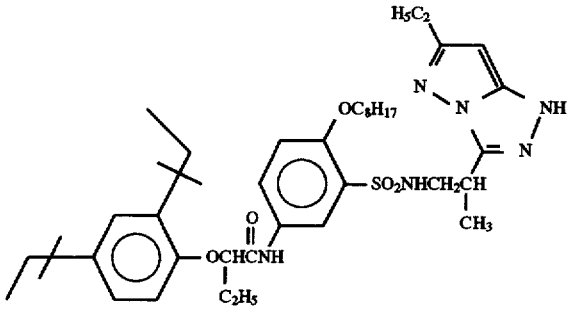
C-29
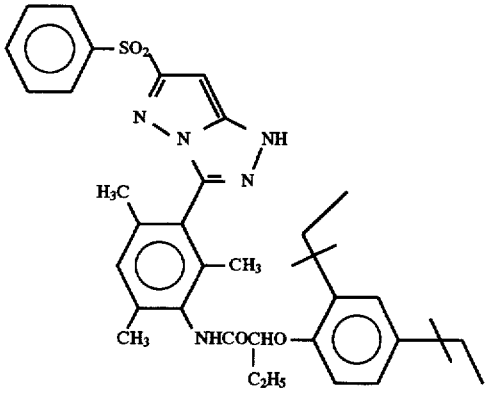

-continued
C-30
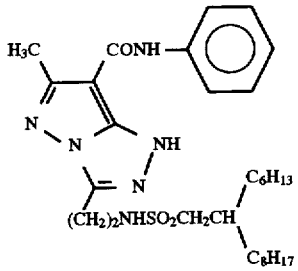
C-31
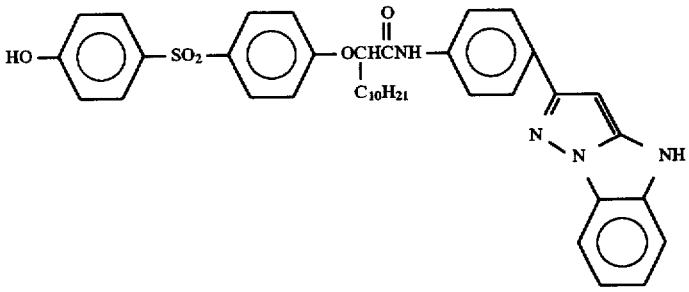
C-32
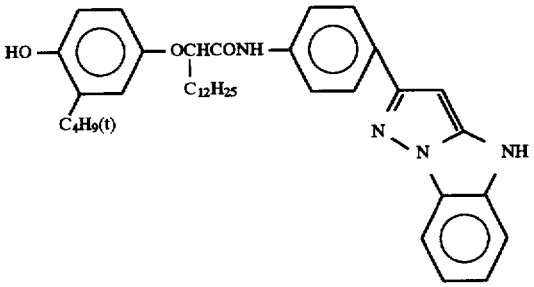
C-33
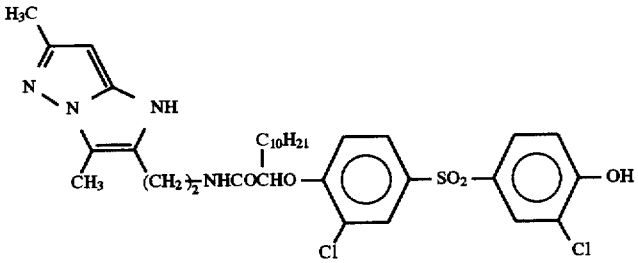
C-34
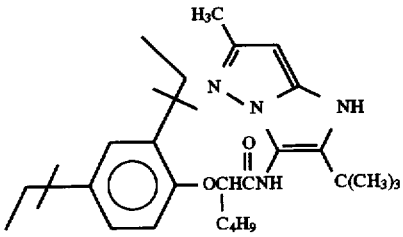
C-35
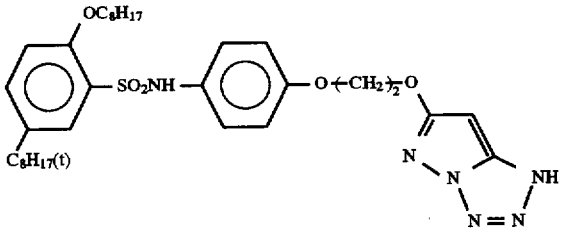

-continued
C-36
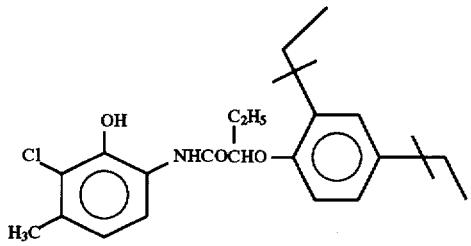
C-37
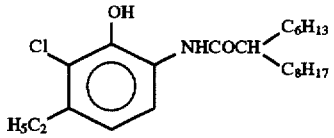
C-38
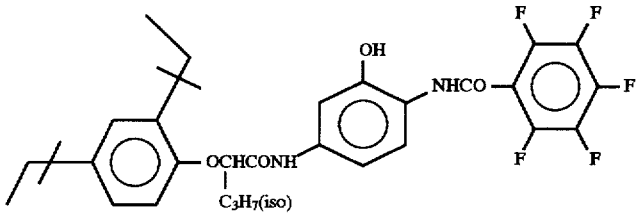
C-39
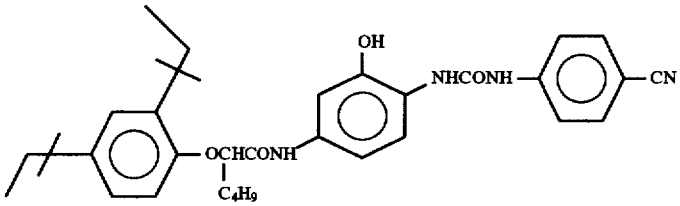
C-40
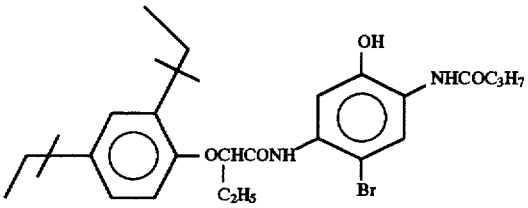
C-41
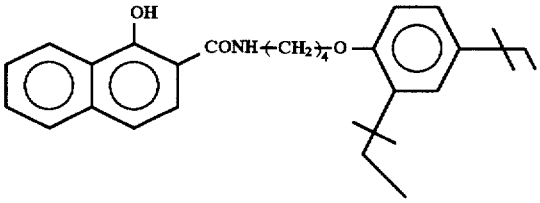
C-42
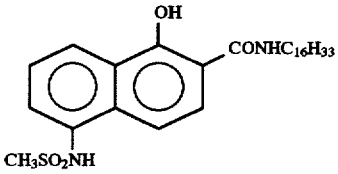
C-43
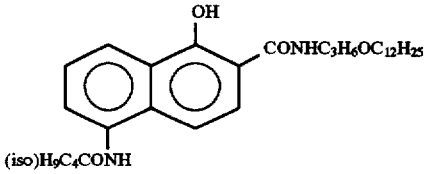

-continued
C-44
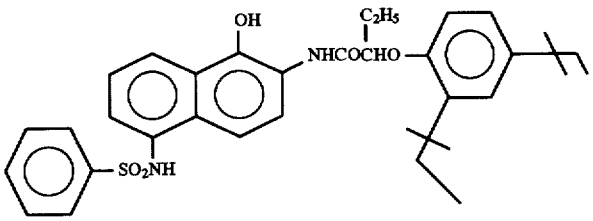
C-45
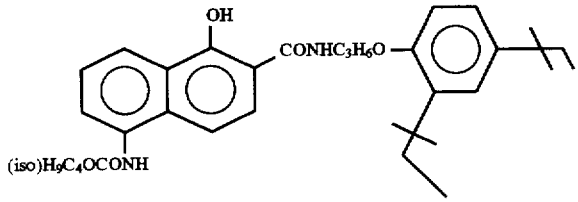
C-46
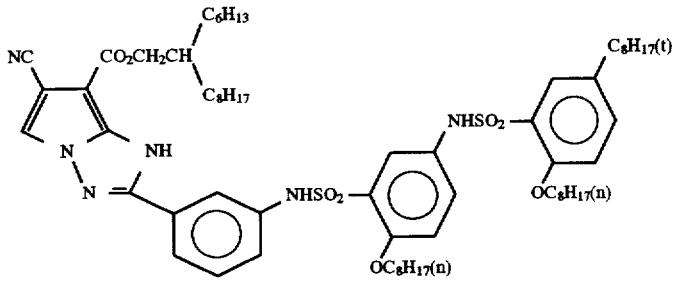
C-47
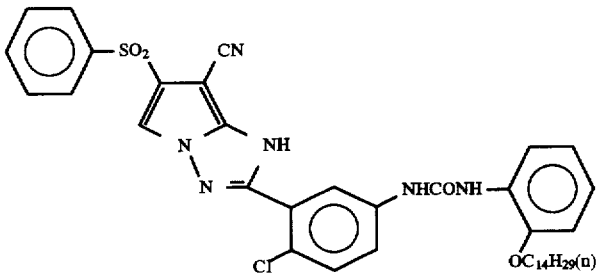
C-48
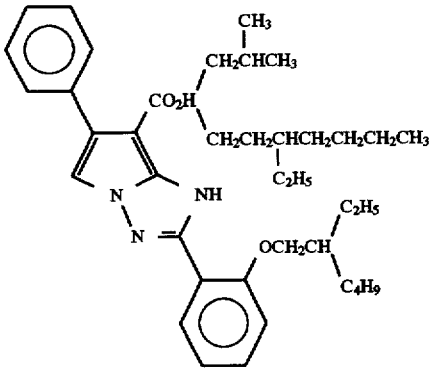
C-49
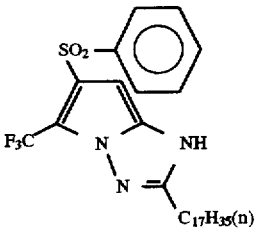

-continued
C-50
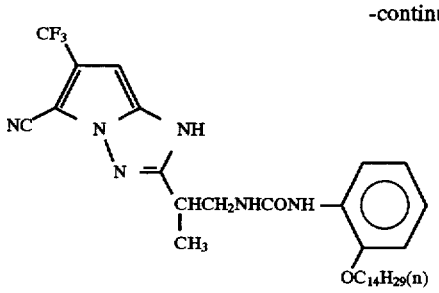
C-51
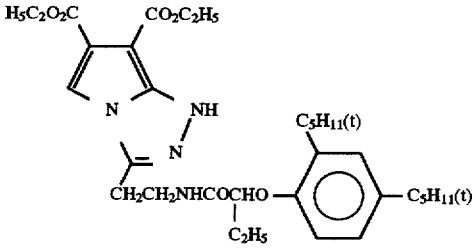
C-52
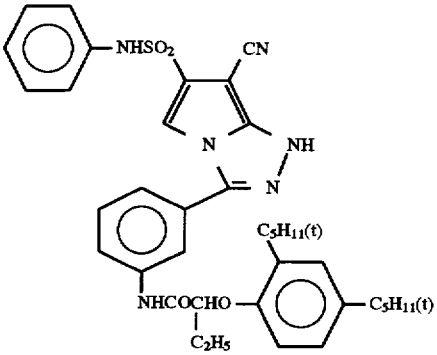
C-53
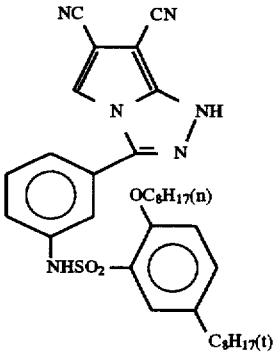
C-54
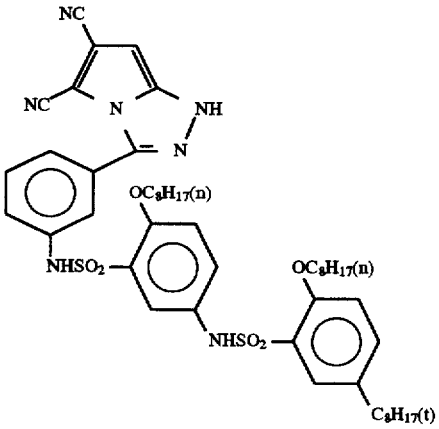

-continued
C-55
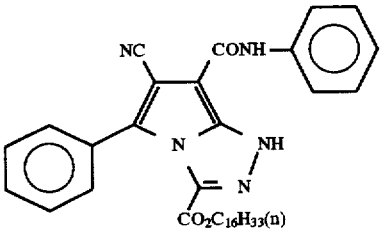
C-56
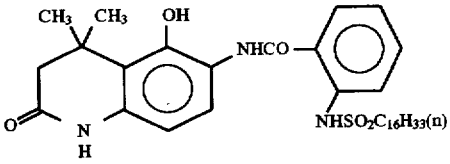
C-57
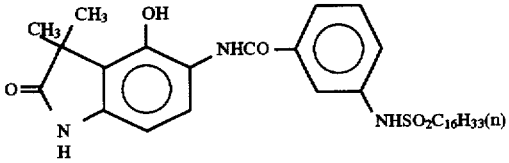
C-58
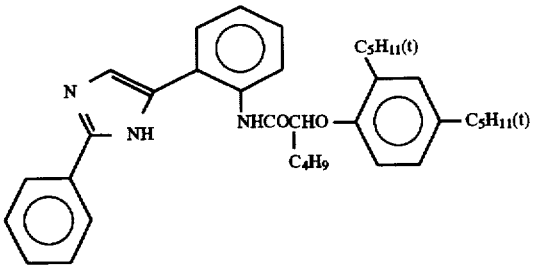
C-59
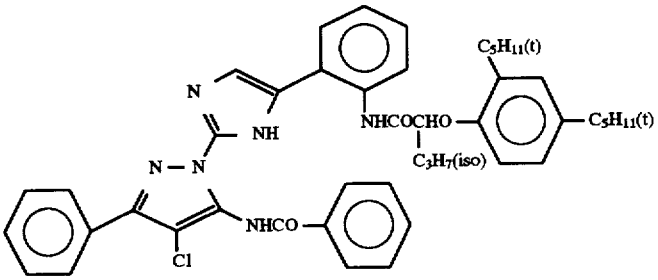
C-60
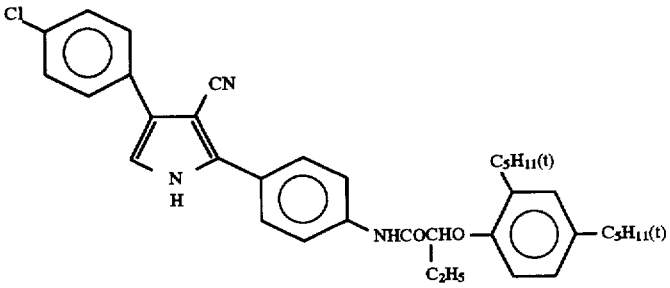

-continued
C-61
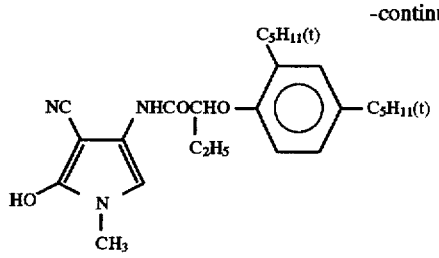
C-62
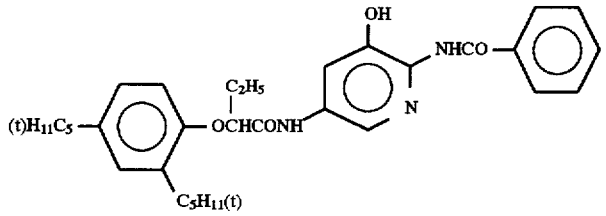
C-63
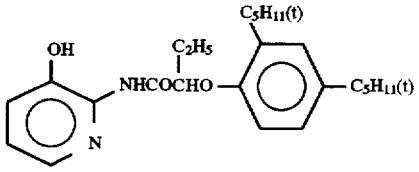
C-64
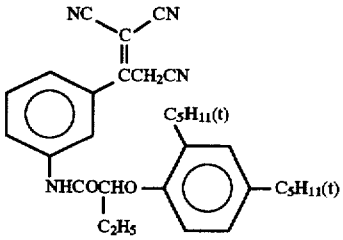
C-65
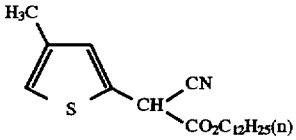
C-66
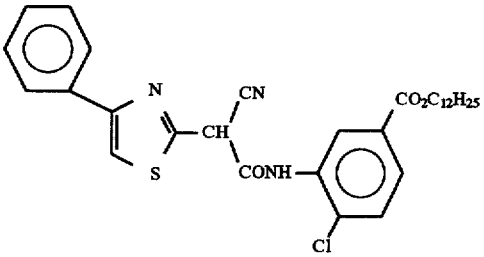
C-67
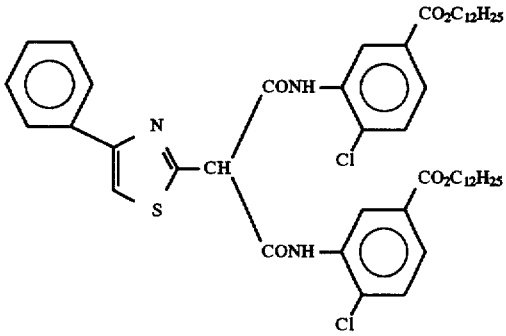

-continued
C-68
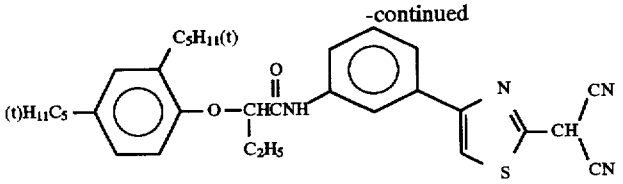
C-69
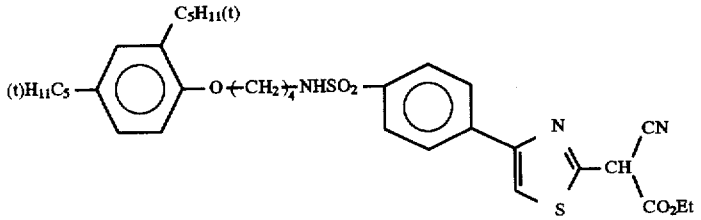
C-70
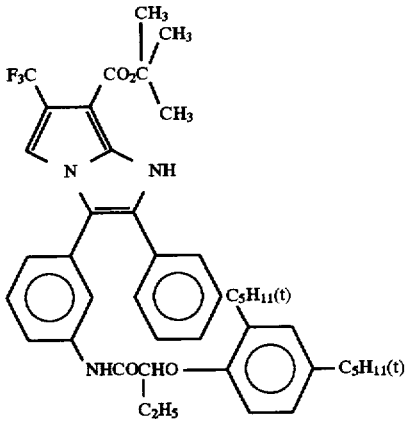
C-71
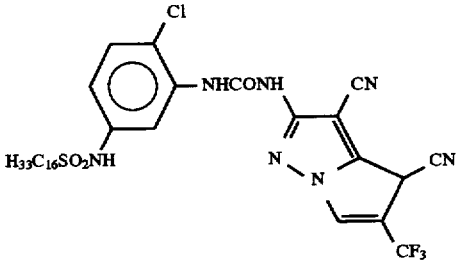
C-72
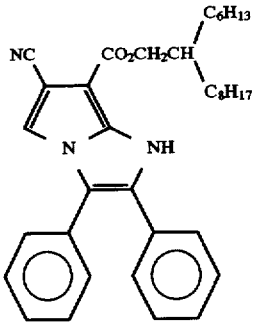
C-73
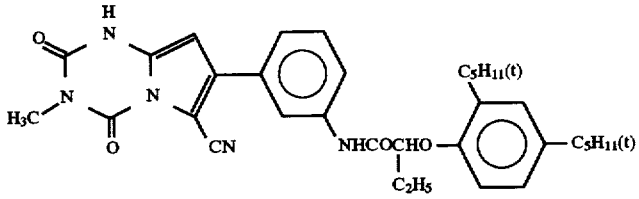

Although the amount of the coupler added depends upon the molar absorption coefficient (e) thereof, in order to obtain an image density of 1.0 or more as a reflection density, it is generally about 0.001 to about 100 mmol/$m^2$. Preferably about 0.01 to about 10 mmol/$m^2$, and more preferably about 0.05 to about 5 mmol/$m^2$ as the amount of the coupler coated, when the coupler produces a dye having a molar absorption coefficient (e) of about 5,000 to about 500,000 by coupling.

The color photographic martial of the present invention basically has a light-sensitive silver halide, a coupler as a dye donating compound, a reducing agent and a binders on a support and can further contain an organic metal salt oxidizing agent, etc. if necessary. These components are added to the same layer in many cases. However, they can be divided to add them to separate layers as long as they are in a reactive state.

In order to obtain a wide range of colors on the chromaticity diagram using the three primary colors of yellow, magenta and cyan, at least three silver halide emulsion layers each having light sensitivity in different spectrum regions are used in combination. For example, a combination or the three layers of a blue-sensitive layer, a green-sensitive layer and a red-sensitive layer, or a combination of a green-sensitive layer, a red-sensitive layer and an infrared-sensitive layer is used. The respective layers can be variously disposed in order as known in the usual color photographic materials. Further, each of these respective light-sensitive layers may be divided into two or more layers if necessary.

The photographic materials can be provided with various auxiliary layers such as a protective layer, an undercoat layer, an intermediate layer, an antihalation layer and a back layer. Further, in order to improve color separation, various filter dyes can also be added.

In general, a base is necessary for processing a photographic material. In the photographic material of the present invention, various methods for feeding the base can be adopted. For example, when a base-generating function is given to the photographic material side, it is possible to incorporate a base precursor into the photographic material.

Examples of such base precursors include salts of organic acids and bases which are decarboxylated by heat, and compounds releasing amines by the intramolecular nuceophilic displacement reaction, the Lossen rearrangement or the Beckmann rearrangement. Examples thereof are described in U.S. Pat. Nos. 4,514,493 and 4,657,848, etc.

Further, when a photographic material is superposed on a processing sheet to process it, a base or a base precursor can also be incorporated into the processing sheet. As the base in this case, an organic base (e.g., an amine derivative), as well as an inorganic base, can be used.

Furthermore, a reaction can also be utilized in which a base precursor is incorporated into both of a photographic material and a processing sheet to generate a base by the reaction of both. Examples of such a binary agent reaction type method of generating the base include a method utilizing a reaction of a sparingly soluble basic metal salt with a chelating agent, and a method utilizing a reaction of a nucleophilic agent with an epoxy compound. These examples are described in JP-A-63-198050, etc.

A silver halide emulsion which can be used in the present invention may be any of silver chloride, silver bromide, silver iodobromide, silver chlorobromide, silver chloroiodide and silver chloroiodobromide.

The silver halide emulsions which can be used in the present invention may be either a surface latent image type emulsions or an internal latent image type emulsion. The internal latent image type emulsion can be used as a direct reversal emulsion in combination with a nucleating agent or light fogging. Further, a so-called core/shell emulsion in which the insides of grains are different from the surfaces thereof in the phase may be used, and silver halides different in composition may be joined by epitaxial junction. Further, the silver halide emulsion may be either a monodisperse emulsion or a polydisperse emulsion, and methods are preferably used in which monodisperse emulsions are mixed to adjust gradation as described in JP-A-1-167743 and JP-A-4-223463. The grain size is preferably from 0.1 to 2 μm, and more preferably from 0.2 to 1.5 μm. The crystal habit of the silver halide grains may be any of a regular crystal form such as a cubic, an octahedral or a tetradecahedral form, an irregular crystal form such as a spherical form or a plate (tabular) form high in aspect ratio, a form having a crystal defect such as a twin plane, and a combined form thereof.

Specifically, any of silver halide emulsions can be used which are prepared by methods described in U.S. Pat. No. 4,500,626, column 50, U.S. Pat. No. 4,628,021, *Research Disclosure* (hereinafter abbreviated as "RD"), No. 17029 (1978), ibid., No. 17643, pages 22 and 23 (December, 1978), ibid., No. 18716, page 648 (November, 1979), ibid., No. 307105, pages 863–865 (November, 1989), JP-A-62-253159, JP-A-64-13546, JP-A-2-236546, JP-A-3-110555, P. Glafkides, *Chemie et Phisigue Photographique* (Paul Montel, 1967), G. F. Duffin, *Photographic Emulsion Chemistry* (Focal Press, 1966) and V. L. Zelikman et al., *Making and Coating Photographic Emulsion* (*Focal Press,* 1964).

In the course of preparation of the light-sensitive silver halide emulsion of the present invention, so-called salt removal for removing excess salts is preferably conducted. As means for this, a noodle water washing method in which gelatin is gelated can be used, and precipitation methods may also be used utilizing a poly-valent anionic inorganic salt (for example, sodium sulfate), an anionic surfactant, an anionic polymer (for example, sodium polystyrenesulfonate) or a gelatin derivative (for example, aliphatic acylated gelatin, aromatic acylated gelatin and aromatic carbamoylated gelatin). The precipitation methods are preferably used.

For various purposes, the light-sensitive silver halide emulsion may contain a heavy metal such as iridium, rhodium, platinum, cadmium, zinc, thallium, lead, iron and osmium. These metals may be used alone or in combination. The amount added is generally about $10^{-9}$ to $10^{-3}$ mole per mole of silver halide, although it depends on the purpose of use. They may be uniformly added to grains or localized in the insides or surfaces of grains. Specifically, emulsions described in JP-A-2-236542, JP-A-1-116637 and JP-A-5-181246 are preferably used.

In the grain forming stage of the light-sensitive silver halide emulsion of the present invention, rhodanides, ammonia, 4-substituted thioether compounds, organic thioether derivatives described in JP-B-47-11386 (the term "JP-B" as used herein means an "examined Japanese patent publication") or sulfur-containing compounds described in JP-A-53-144319 can be used as a silver halide solvent.

For other conditions, reference can be made to the descriptions of P. Glafkides, *Chemie et Phisique Photographique* (Paul Montel, 1967), G. F. Duffin, *Photographic Emulsion Chemistry* (Focal Press, 1966) and V. L. Zelikman et al., *Making and Coating Photographic Emulsion* (Focal Press, 1964) which are described above. That is, any of an acid process, a neutral process and an ammonia process may be used. A soluble silver salt and a soluble halogen salt may be reacted with each other by using any of a single jet process, a double jet process and a combination thereof. In order to obtain monodisperse emulsions, the double jet process is preferably used.

A reverse mixing process in which grains are formed in the presence of excess silver ions can also be used. As a type of double jet process, a process for maintaining constant the pAg in a liquid phase forming a silver halide, namely a so-called controlled double jet process, can also be used.

In order to accelerate the growth of grains, the concentration, the amount and the rate of silver salts and halogen salts added may be increased (JP-A-55-142329, JP-A-55-158124 and U.S. Pat. No. 3,650,757).

Further, reaction solutions may be stirred by any of the known stirring methods. The temperature and the pH of the reaction solution during formation of silver halide grains may be arbitrarily selected depending on the purpose. The pH range is preferably 2.2 to 8.5, and more preferably 2.5 to 7.5.

Light-sensitive silver halide emulsions are usually chemically sensitized. For chemical sensitization of the light-sensitive silver halide emulsion of the present invention, chalcogen sensitization such as sulfur sensitization, selenium sensitization or tellurium sensitization, noble metal sensitization using gold, platinum, palladium, etc. and reduction sensitization which are known in the emulsions for ordinary type photographic materials can be used alone or in combination (for example, JP-A-3-110555 and JP-A-5-241267). Such chemical sensitization can also be conducted in the presence of a nitrogen-containing heterocyclic compound (JP-A-62-253159). Further, an antifoggant set out below can be added after chemical sensitization. Specifically, methods described in JP-A-5-45833 and JP-A-62-40446 can be used.

The pH on chemical sensitization is preferably 5.3 to 10.5, and more preferably 5.5 to 8.5, and the pAg is preferably 6.0 to 10.5, and more preferably 6.8 to 9.0.

The coated amount of the light-sensitive silver halide emulsions used in the present invention is preferably 1 mg to 10 g/m$^2$ in terms of silver.

In order to give the color sensitivities of green, red and infrared sensitivities to the light-sensitive silver halide emulsion used in the present invention, the light-sensitive silver halide emulsions are spectrally sensitized with methine dyes or the like. Further, spectral sensitization of a blue region may be applied to a blue-sensitive emulsion as needed.

The dyes used include cyanine dyes, merocyanine dyes, complex cyanine dyes, complex merocyanine dyes, holopolarcyanine dyes, hemicyanine dyes, styryl dyes and hemioxanol dyes.

Specifically, they include sensitizing dyes described in U.S. Pat. No. 4,617,257, JP-A-59-180550, JP-A-64-13546, JP-A-5-45828 and JP-A-5-45834.

These sensitizing dyes may be used alone or in combination. The combinations of the sensitizing dyes are often used, particularly for supersensitization and wavelength adjustment of spectral sensitivity.

The emulsions may contain dyes having no color sensitization themselves or compounds which do not substantially absorb visible light and exhibit supersensitization, in combination with the sensitizing dyes (for example, ones described in U.S. Pat. No. 3,615,641 and JP-A-63-23145).

These sensitizing dye may be added to the emulsion during chemical ripening, before or after it, or before or after nucleation of the silver halide grains according to U.S. Pat. Nos. 4,183,756 and 4,225,566. The sensitizing dye and supersensitizer may be added in the form of a solution in an organic solvent such as methanol, a dispersion in gelatin or a solution of a surfactant. The sensitizing agent can be generally added in an amount of from about $10^{-8}$ to about $10^{-2}$ mole per mole of silver halide.

Additives used in such processes and known photographic additives which can be used in the heat developable photographic materials and dye fixing materials of the present invention are described in RD, No. 17643, ibid., No. [8716 and ibid., No. 307105 described above and corresponding portions thereof are summarized in the following table.

| Type of Additives | RD17643 | RD18716 | RD307105 |
|---|---|---|---|
| 1. Chemical Sensitizers | p. 23 | p. 648, right column | p. 866 |
| 2. Sensitivity Increasing Agents | | p. 648, right column | |
| 3. Spectral Sensitizers, Supersensitizers | pp. 23–24 | p. 648, right column to p. 649, right column | pp. 866–868 |
| 4. Fluorescent Brightening Agents | p. 24 | p. 648, right column | p. 868 |
| 5. Antifoggants, Stabilizers | pp. 24–25 | p. 649, right column | pp. 868–870 |
| 6. Light Absorbers, Filter dyes, UV Absorbers | pp. 25–26 | p. 649, right column to p. 650, left column | p. 873 |
| 7. Dye Image Stabilizers | p. 25 | p. 650, left column | p. 872 |
| 8. Hardeners | p. 26 | p. 651, left column | pp. 874–875 |
| 9. Binders | p. 26 | p. 651, left column | pp. 873–874 |
| 10. Plasticizers, Lubricants | p. 27 | p. 650, right column | p. 876 |
| 11. Coating Aids, Surfactants | pp. 26–27 | p. 650 right column | pp. 875–876 |
| 12. Antistatic Agents | p. 27 | p. 650 right column | pp. 876–877 |
| 13. Matte Agents | | | pp. 878–879 |

As the binders for the layers constituting the heat developable photographic materials, hydrophilic binders are preferably used. Examples thereof include binders described in Research Disclosures stated above and JP-A-64-13546, pages 71 to 75. Specifically, transparent or translucent hydrophilic binders are preferred, and examples thereof include natural compounds such as proteins (for example, gelatin and gelatin derivatives) and polysaccharides (for example, cellulose derivatives, starch, gum arabic, dextran and pullulan), and synthetic polymers such as polyvinyl alcohol, polyvinylpyrrolidone and polyacrylamide. Further, high water-absorptive polymers described in U.S. Pat. No. 4,960,681 and JP-A-62-245260, namely homopolymers of vinyl monomers having —COOM or —$SO_3M$ (wherein M represents a hydrogen atom or an alkali metal), or copolymers of these vinyl monomers with each other or with other monomers (for example, sodium methacrylate, ammonium methacrylate and Sumikagel L-5H manufactured by Sumitomo Chemical Co, Ltd.), can also be used. These binders can be used in combination. In particular, combinations of gelatin and the above-mentioned binders are preferred. Gelatin is selected from lime-treated gelatin, acid-treated gelatin and so-called delimed gelatin reduced in content of calcium, etc., depending on various purposes, and they are also preferably used in combination.

In the present invention, an organic metal salt can also be used as an oxidizing agent in combination with the light-sensitive silver halide emulsion. As the orgasmic metal salt, an organic silver salt is particularly preferably used.

Organic compounds which can be used for formation of the above-mentioned organic silver salt oxidizing agent include benzotriazole compounds, fatty acids and other compounds described in U.S. Pat. No. 4,500,626, columns 52 and 53. Silver acetylide described in U.S. Pat. No. 4,775,613 is also useful. Two or more of the organic silver salt may be used in combination.

The organic silver salt can be used generally in an amount of 0.01 to 10 moles per mole of light-sensitive silver halide, and preferably in an amount of 0.01 to 1 mole. The total coated amount of the light-sensitive silver halide emulsion and the organic silver salt is generally from 0.05 to 10 $g/m^2$ in terms of silver, and preferably from 0.1 to 4 $g/m^2$.

In the heat developable photographic materials of the present invention, a compound for activating development and stabilizing an image can be used. Preferred examples of the compound include those described in U.S. Pat. No. 4,500,626, columns 51 and 52. Further, compounds which can fix silver halides as described in Japanese Patent Application No. 6-206331 can also be used.

The hardener which can be used in the layers constituting the heat developable photographic materials include hardeners described in Research Disclosures stated above, U.S. Pat. Nos. 4,678,739, column 41, and 4,791,042, JP-A-59-116655, JP-A-62-245261, JP-A-61-18942, JP-A-4-218044, etc. More specifically, examples thereof include aldehyde hardeners (such as formaldehyde), aziridine hardeners, epoxy hardeners, vinyl sulfone hardeners (such as N,N'-ethylene-bis(vinyl-sulfonylacetamido)ethane), N-methylol hardeners (dimethylolurea) and polymer hardeners (compounds described in JP-A-62-234157).

The hardener can be used generally in an amount of 0.001 to 1 g, preferably 0.005 to 0.5 g, per g of gelatin coated. It may be added to any of the layers constituting the photographic materials or dye fixing materials, and may be added to two or more layers.

In the layers constituting the heat developable photographic material, various antifoggants or photographic stabilizers and precursors thereof can be used. Examples thereof include compounds described in Research Disclosures stated above, U.S. Pat. Nos. 5,089,378, 4,500,627 and 4,614,702, JP-A-64-13546, pages 7-9, 57-71 and 81-97, U.S. Pat. Nos. 4,775,610, 4,626,500 and 4,983,494, JP-A-62-174747, JP-A-62-239148, JP-A-63-264747, JP-A-1-150135, JP-A-2-110557, JP-A-2-178650, RD, 17643 (1978), pages 24 and 25, etc.

These compounds are preferably used in an amount of $5\times10^{-6}$ to $1\times10^{-1}$ mole per mole of silver, and more preferably in an amount of $1\times10^{-5}$ to $1\times10^{-2}$ mole.

In the layers constituting the heat developable photographic material, various surfactants can be used for the purposes of assisting coating, improving separation, improving slipperiness, preventing electric charge, and accelerating development. Examples of the surfactant are described in Research Disclosures stated above, JP-A-62-173463, JP-A-62- 183457, etc.

The layers constituting the heat developable photographic material may contain an organic fluoro compound for the purposes of improving slipperiness, preventing electric charge and improving separation. Typical examples of the organic fluoro compound include fluorine surfactants described in JP-B-57-9053, columns 8 to 17, JP-A-51-20944, JP-A-62-135825, etc. and hydrophobic fluorine compounds such as oily fluorine compounds (for example, fluorine oil) and solid fluorine compounds (for example, ethylene tetrafluoride resins).

The heat developable photographic materials can contain a matte agent for the purposes of preventing adhesion, improving slipperiness and delustering surfaces of the photographic material. Examples of the matte agent include compounds such as benzoguanamine resin beads, polycarbonate resin beads and AS resin beads described in JP-A-63-274944 and JP-A-63-274952, as well as compounds such as silicon dioxide, polyolefins and polymethacrylates described in JP-A-61-88256, page 29. In addition, compounds described in Research Disclosures stated above can be used. The matte agent can be added not only to the uppermost layer (protective layer), but also to the lower layers as needed.

Besides, the layers constituting the heat developable photographic material may contain a thermal solvent, an antifoaming agent, a microbicidal antifungal agent and colloidal silica. Examples of these additives are described in JP-A-61-88256, pages 26 to 32, JP-A-3-11338 and JP-B-2-51496.

In the present invention, an image formation accelerating agent can be used in the heat developable photographic material. The image formation accelerating agent has the functions of accelerating the oxidation-reduction reaction of a silver salt oxidizing agent with a reducing agent and accelerating the dye formation reaction, and can be classified into a bases or base precursor, a nucleophilic compound, a high boiling organic solvent (oil), a thermal solvent, a surfactant, a compound having interaction with silver or silver ion, etc. according to the physicochemical functions. However, a group of these substances generally has combined functions, and therefore, it has usually a combinations of some of the above-mentioned accelerating effects. The details thereof are described in U.S. Pat. No. 4,678,739, columns 38 to 40.

In the heat developable photographic material of the present invention, various development stoppers can be used for the purpose of obtaining always constant images against fluctuations in processing temperature and processing time in development.

The development stopper as used herein is a compound which, after proper development, rapidly neutralizes or reacts with a base to reduce the concentration of the base contained in a film, thereby stopping development, or a compound which interacts with silver and a silver salt to inhibit development. Examples thereof include an acid precursor releasing an acid by heating, an electrophilic compound which conducts replacement reaction with coexisting a base by heating, a nitrogen-containing a heterocyclic compound, a mercapto compound and a precursor thereof. More specifically, they are described in JP-A-62-253159, pages 31 and 32.

Methods for exposing the heat developable photographic materials to record an image include, for example, methods of directly taking landscape photographs or human subject photographs by use of cameras, methods of exposing the photographic materials through reversal films or negative films by use of printers or enlargers, methods of subjecting original pictures to scanning exposure through slits by use of exposing devices of copying machines, methods of allowing light emitting diodes or various lasers (such as laser diodes and gas lasers) to emit light by image information through electric signals to subject the photographic materials to scanning exposure (methods described in JP-A-2-129625, JP-A-5-176144, JP-A-5-199372 and JP-A-6-127021), and methods of supplying image information to image displays such as CRTs, liquid crystal displays, electroluminescence displays and plasma displays to expose the photographic material directly or through an optical system.

As described above, light sources and exposing methods such as natural light, tungsten lamps, light emitting diodes, laser sources and CRT light sources described in U.S. Pat. No. 4,500,626, column 56, JP-A-2-53378 and JP-A-2-54672 can be used to record an image on the heat developable photographic materials.

Further, images can also be exposed using wavelength converting elements in which non-linear optical materials and coherent light sources such as laser beams are combined. Here, the non-linear optical material is a material which can express non-linearity between an electrical field and polarization appearing when a strong optical electrical field such as a laser beam is given. Examples of such materials preferably used include inorganic compounds represented by lithium niobate, potassium dihydrogenphosphate (KDP), lithium iodate and $BaB_2O_4$, urea derivatives, nitroaniline derivatives, nitropyridine-N-oxide derivatives such as 3-methyl-4-nitropyridine-N-oxide (POM), and compounds described in JP-A-61-53462 and JP-A-62-210432. As the forms of the wavelength converting elements, the single crystal optical waveguide path type and the fiber type are known, and both are Further, in the above-mentioned image information, image signals obtained from video cameras, electronic still cameras, etc., television signals represented by the Nippon Television Signal Criteria (NTSC), image signals obtained by dividing original pictures into many picture elements with scanners, etc. and image signals produced by use of computers represented by CGs and CADs can be utilized.

The heat developable photographic material of the present invention may have a conductive exothermic layer as a heating means for heat development. In this case, an exothermic element described in JP-A-61-145544 can be utilized.

The heating temperature in the heat development stage is generally from about 80° C. to about 180° C., and the heating time is generally from 0.1 seconds to 60 seconds.

Heating methods in the development stage include a method of bringing the photographic material into contact with a heated block, a heated plate, a hot presser, a heated roll, a heated drum, a halogen lamp heater, an infrared or far infrared lamp heater, etc., and a method of passing the photographic material through an atmosphere of high temperature.

To superposition of the heat developable photographic materials and the dye fixing materials, methods described in JP-A-62-253159 and JP-A-61-147244, page 27 can be applied.

As the support for the photosensitive material of the present invention, any supports known in the art, particularly, those for the conventional heat developable photosensitive materials, can be used. Examples of such a support include a paper support laminated with polyethylene and a support of polyesters represented by polyethylene terephthalate and polyethylene naphthalate. Examples of such supports are described in JP-A-63-189860 in detail.

In addition to the above-mentioned supports, supports obtained by orienting styrenic polymers having syndiotactic structures can also be preferably used. Similarly to the above-mentioned supports, these polymer supports may be either homopolymers or copolymers. Details of such polymer supports are described in Japanese Patent Application No. 7-45079.

The effects of the present invention will be described in detail with reference to the following examples.

EXAMPLE 1

Methods for Preparing Light-Sensitive Silver Halide Emulsions Light-Sensitive Silver Halide Emulsion (1) (for Red-Sensitive Emulsion Layer Solution (1) and solution (2) shown in Table 1 were concurrently added to a well-stirred aqueous solution of gelatin (a solution of 16 g of gelatin, 0.24 g of potassium bromide, 1.6 g of sodium chloride and 24 mg of compound (a) in 540 ml of water heated at 55° C.) at the same flow rate for 19 minutes. After 5 minutes, solutions (3) and (4) shown in Table 1 were concurrently added thereto at the same flow rate for 24 minutes. After washing and salt removal by a conventional method, 17.6 g of lime-treated ossein gelatin and 56 mg of compound (b) were added to adjust the pH and the pAg Lo 6.2 and 7.7, respectively. Then, 0.41 g of a decomposed product of ribonucleic acid and 1.02 mg of trimethylthiourea were added, followed by optimum chemical sensitization at 60° C. Thereafter, 0.18 g of 4-hydroxy-6-methyl-1,3,3a,7-tetraazainedene, 64 mg of sensitizing dye (c) and 0.41 g of potassium bromide were in turn added, followed by cooling. Thus, 590 g of a monodisperse cubic silver chlorobromide emulsion having a mean grain size of 0.30 μm was obtained.

TABLE 1

| | Solution (1) | Solution (2) | Solution (3) | Solution (4) |
|---|---|---|---|---|
| $AgNO_3$ | 24.0 g | — | 56.0 g | — |
| $NH_4NO_3$ | 50.0 mg | — | 50.0 mg | — |
| KBr | — | 10.9 g | — | 35.3 g |
| NaCl | — | 2.88 g | — | 1.92 g |
| $K_2IrCl_6$ | — | 0.07 mg | — | — |
| Amount Completed | Water to make 130 ml | Water to make 200 ml | Water to make 130 ml | Water to make 200 ml |

Compound (a)

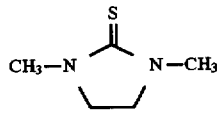

TABLE 1-continued

| | Solution (1) | Solution (2) | Solution (3) | Solution (4) |
|---|---|---|---|---|
| Compound (b) | 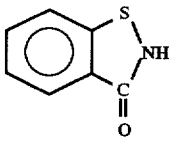 | | | |
| Dye (c) | 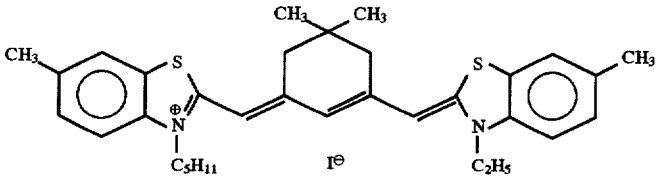 | | | |

Light-Sensitive Silver Halide Emulsion (2) (for Green-Sensitive Emulsion Layer)

Solution (1) and solution (2) shown in Table 2 were concurrently added to a well-stirred aqueous solution of gelatin (a solution of 20 g of gelatin, 0.30 g of potassium bromide, 2.0 g of sodium chloride and 30 mg of compound (a) in 600 ml of water heated at 46° C.) at the same flow rate for 10 minutes. After 5 minutes, solution (3) and solution (4) shown in Table 2 were further concurrently added thereto at the same flow rate for 30 minutes. One minute after termination of addition of solutions (3) and (4), 600 ml of a solution of sensitizing dyes in methanol (containing 360 mg of sensitizing dye ($d_1$) and 73.4 mg of sensitizing dye ($d_2$)) was added in one lot. After washing and salt removal (conducted using precipitating agent (e) at pH 4.0) by a conventional method, 22 g of lime-treated ossein gelatin was added to adjust the pH and the pAg to 6.0 and 7.6, respectively. Then, 1.8 mg of sodium thiosulfate and 180 mg of 4-hydroxy-6-methyl-1,3,3a,7-tetraazainedene were added, followed by optimum chemical sensitization at 60° C. Thereafter, 90 mg of antifoggant (f), and 70 mg of compound (b) and 3 ml of compound (g) as preservatives were added, followed by cooling. Thus, 635 g of a monodisperse cubic silver chlorobromide emulsion having a mean grain size of 0.30 μm was obtained.

TABLE 2

| | Solution (1) | Solution (2) | Solution (3) | Solution (4) |
|---|---|---|---|---|
| $AgNO_3$ | 10.0 g | — | 90.0 g | — |
| $NH_4NO_3$ | 60.0 mg | — | 380 mg | — |
| KBr | — | 3.50 g | — | 57.1 g |
| NaCl | — | 1.72 g | — | 3.13 g |
| $K_2IrCl_6$ | — | — | — | 0.03 mg |
| Amount Completed | Water to make 126 ml | Water to make 131 ml | Water to make 280 ml | Water to make 289 ml |

Dye ($d_1$)

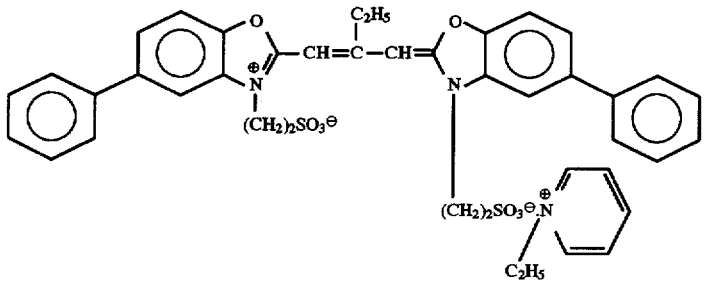

Dye ($d_2$)

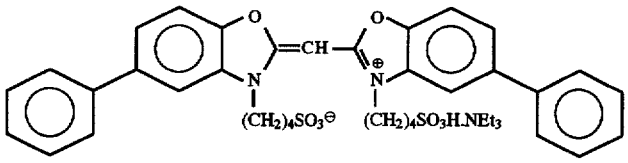

TABLE 2-continued

| | Solution (1) | Solution (2) | Solution (3) | Solution (4) |
|---|---|---|---|---|
| Precipitating Agent (e) | 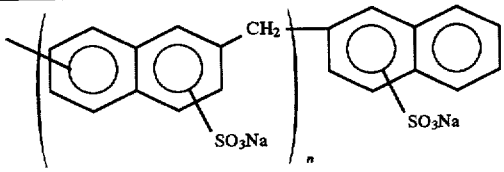 | | | |
| Antifoggant (f) | 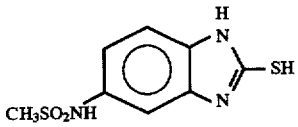 | | | |
| Compound (g) | 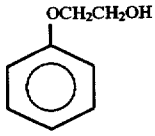 | | | |

Light-Sensitive Silver Halide Emulsion (3) (for Blue-Sensitive Emulsion Layer)

First, addition of solution (2) shown in Table 3 to a well-stirred aqueous solution of gelatin (a solution of 31.6 g of gelatin, 2.5 g of potassium bromide and 13 mg of compound (a) in 584 ml of water heated at 70° C.) was started. After 10 minutes, addition of solution (1) was started. Solutions (1) and (2) were thereafter added over a period of 30 minutes. Five minutes after termination of addition of solution (2), addition of solution (4) shown in Table 3 was further started, and after 10 seconds, addition of solution (3) was started. Solution (3) was added over a period of 27 minutes and 50 seconds, and solution (4) was added over a period of 28 minutes. After washing and salt removal (conducted using precipitating agent (j) at pH 3.9) by a conventional method, 24.6 g of lime-treated ossein gelatin and 56 mg of compound (b) were added to adjust the pH and the pAg to 6.1 and 8.5, respectively. Then, 0.55 mg of sodium thiosulfate was added, followed by optimum chemical sensitization at 65° C. Thereafter, 0.35 g of sensitizing dye (h), 56 mg of antifoggant (i) and 2.3 ml of compound (g) as a preservative were added, followed by cooling. Thus, 582 g of a monodisperse octahedral silver bromide emulsion having a mean grain size of 0.55 μm was obtained.

TABLE 3

| | Solution (1) | Solution (2) | Solution (3) | Solution (4) |
|---|---|---|---|---|
| $AgNO_3$ | 15.8 g | — | 72.2 g | — |
| $NH_4NO_3$ | 69.0 mg | — | 308 mg | — |
| KBr | — | 11.4 g | — | 52.2 g |
| Amount Completed | Water to make 134 ml | Water to make 134 ml | Water to make 194 ml | Water to make 195 ml |

TABLE 3-continued

| | Solution (1) | Solution (2) | Solution (3) | Solution (4) |
|---|---|---|---|---|
| Precipitating Agent (j) | 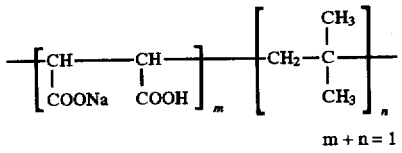 m + n = 1 | | | |
| Dye (h) | 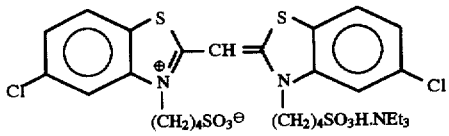 | | | |
| Antifoggant (i) | 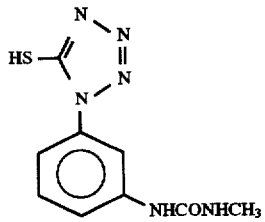 | | | |

Preparation of Zinc Hydroxide Dispersion

A powder of zinc hydroxide (31 g) in which the grain size of primary grains is 0.2 μm, 1.6 g of carboxymethyl cellulose and 0.4 g of polysodium acrylate as dispersing agents, 8.5 g of lime-treated ossein gelatin and 158.5 ml of water were mixed, and the resulting mixture was dispersed in a mill using glass beads for 1 hour. After dispersion, the glass beads were filtered off to obtain 188 g of a zinc hydroxide dispersion.

Preparation of Emulsified Dispersions of Couplers

The oil phase ingredients and aqueous phase ingredients shown in Table 4 were each dissolved to form homogeneous solutions having a temperature of 60° C. Both the solutions were combined and dispersed in a 1-liter stainless steel vessel with a dissolver equipped with a 5-cm diameter disperser at 10,000 rpm for 20 minutes. Then, hot water was added in amounts shown in Table 4 as post water addition, followed by mixing at 2,000 rpm for 10 minutes. Thus, emulsified dispersions of three colors of cyan, magenta and yellow were prepared.

TABLE 4

| | | Cyan | Magenta | Yellow |
|---|---|---|---|---|
| Oil Phase | Cyan Coupler (1) | 4.35 g | — | — |
| | Magenta Coupler (2) | — | 3.18 g | — |
| | Yellow Coupler (3) | — | — | 3.36 g |
| | Developing Agent (4) | 4.67 g | 4.67 g | — |
| | Developing Agent (5) | — | — | 5.70 g |
| | High Boiling Solvent (6) | 4.51 g | 3.88 g | 4.53 g |
| | Ethyl Acetate | 24 ml | 24 ml | 24 ml |
| Aqueous Phase | Lime-Treated Gelatin | 10.0 g | 10.0 g | 10.0 g |
| | Surfactant (7) | 0.50 g | 0.50 g | 0.50 g |
| | Water | 75.0 ml | 75.0 ml | 75.0 ml |
| | Post Water Addition | 80.0 ml | 80.0 ml | 80.0 ml |

Cyan Coupler (1)

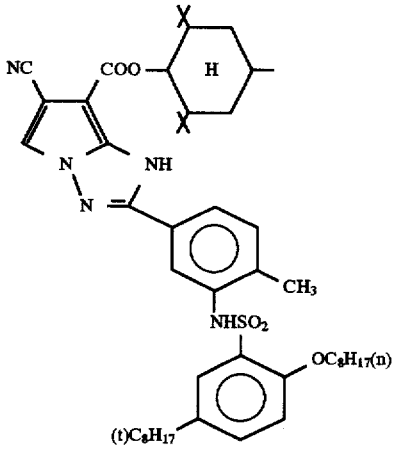

Magenta Coupler (2)

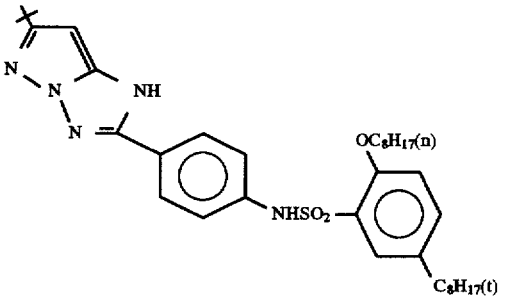

TABLE 4-continued

| | Cyan | Magenta | Yellow |
|---|---|---|---|

Yellow Coupler (3)

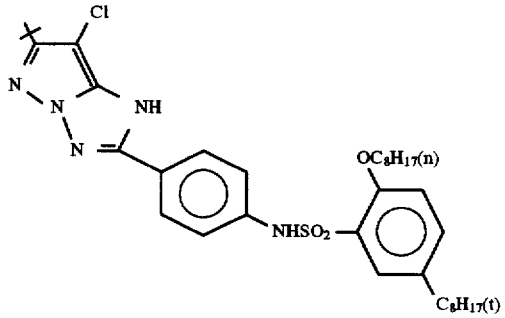

Developing Agent (4)

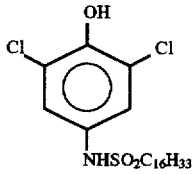

Developing Agent (5)

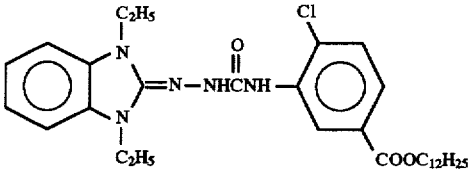

High Boiling Solvent (6)

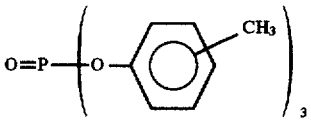

Surfactant (7)

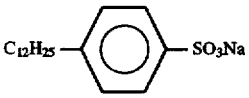

Surfactant (8)

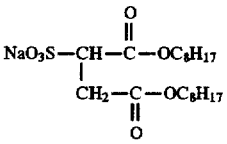

Surfactant (9)

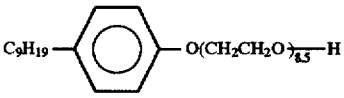

TABLE 4-continued

| | Cyan | Magenta | Yellow |
|---|---|---|---|
| Water-Soluble Polymer (10) | | | |

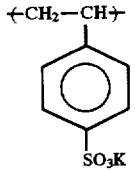

Hardener (13)
$CH_2=CH-SO_2-CH_2-SO_2-CH=CH_2$

Using the materials thus obtained, heat developable color photographic material 101 having the multilayer constitution shown in Table 5 was prepared.

TABLE 5

Constitution of Photographic Material 101

| Layer Constitution | Material Added | Amount Added ($mg/m^2$) |
|---|---|---|
| 6th Layer Protective Layer | Lime-Treated Gelatin | 1940 |
| | Matte Agent (Silica) | 200 |
| | Surfactant (8) | 50 |
| | Surfactant (9) | 300 |
| | Zinc Hydroxide | 900 |
| | Water-Soluble Polymer (10) | 120 |
| 5th Layer Yellow Color Formation Layer | Lime-Treated Gelatin | 1500 |
| | Blue-Sensitive Silver Halide Emulsion | 864 (converted to silver) |
| | Yellow Coupler (3) | 336 |
| | Developing Agent (5) | 570 |
| | High Boiling Solvent (6) | 453 |
| | Surfactant (7) | 50 |
| | Water-Soluble Polymer (10) | 40 |
| 4th Layer Intermediate Layer | Lime-Treated Gelatin | 970 |
| | Surfactant (8) | 50 |
| | Surfactant (9) | 300 |
| | Hardener (13) | 85 |
| | Water-Soluble Polymer (10) | 60 |
| 3rd Layer Magenta Color Formation Layer | Lime-Treated Gelatin | 1500 |
| | Green-Sensitive Silver Halide Emulsion | 864 (converted to silver) |
| | Magenta Coupler (2) | 318 |
| | Developing Agent (4) | 467 |
| | High Boiling Solvent (6) | 388 |
| | Surfactant (7) | 50 |
| | Water-Soluble Polymer (10) | 20 |
| 2nd Layer Intermediate Layer | Lime-Treated Gelatin | 970 |
| | Surfactant (8) | 50 |
| | Surfactant (9) | 300 |
| | Zinc Hydroxide | 900 |
| | Water-Soluble Polymer (10) | 60 |
| 1st Layer Cyan Color Formation Layer | Lime-Treated Gelatin | 1500 |
| | Red-Sensitive Silver Halide Emulsion | 864 (converted to silver) |
| | Cyan Coupler (1) | 435 |
| | Developing Agent (4) | 467 |
| | High Boiling Solvent (6) | 451 |
| | Surfactant (7) | 40 |
| | Water-Soluble Polymer (10) | 20 |

Transparent PET Base (102 μm)

Then, photographic materials 102 to 116 were prepared in the same manner as the preparation of photographic material except that the developing agents of the first and third layers were changed as shown in Table 6. A magazine of FUJIX PICTROSTAT 200 (manufactured by Fuji Photo Film Co. Ltd.) was loaded with each of these samples, and a slide enlarging unit is equipped with B, G and R filters continuously changed in density to conduct heat development under the standard conditions (at this time, base generating agent-containing image-receiving materials described in JP-A-5-188554 were used as image-receiving materials). When the image-receiving material was separated after processing, color images of cyan, magenta and yellow were clearly obtained on the photographic material side, corresponding to the filters through which the sample was exposed. Immediately after processing, the maximum density (Dmax) and the minimum density (Dmin) of each sample were measured with an X-rite densitometer. Results are shown in Table 7.

TABLE 6

| Sample | Cyan Agent | Cyan Amount Added | Magenta Agent | Magenta Amount Added | Hammett σ Value of Releasing Group of Agent*1 |
|---|---|---|---|---|---|
| 101 (Comparison) | (4) | 1.0 | (4) | 1.0 | — |
| 102 (Comparison) | (4) | 2.0 | (4) | 2.0 | — |
| 103 (Comparison) | A | 1.0 | A | 1.0 | −0.32 |
| 104 (Comparison) | B | 1.0 | B | 1.0 | 0.74 |
| 105 (Comparison) | C | 1.0 | C | 1.0 | — |
| 106 (Comparison) | A | 2.0 | A | 2.0 | −0.32 |
| 107 (Invention) | D-1 | 1.0 | D-1 | 1.0 | −0.45 |
| 108 (Invention) | D-3 | 1.0 | D-3 | 1.0 | −0.66 |
| 109 (Invention) | D-7 | 1.0 | D-7 | 1.0 | −0.36 |
| 110 (Invention) | D-11 | 1.0 | D-11 | 1.0 | 0.57 |
| 111 (Invention) | D-12 | 1.0 | D-12 | 1.0 | −0.45 |
| 112 (Invention) | D-15 | 1.0 | D-15 | 1.0 | −0.45 |
| 113 (Invention) | D-21 | 1.0 | D-21 | 1.0 | 0.50 |
| 114 (Invention) | D-23 | 1.0 | D-23 | 1.0 | 0.72 |
| 115 (Invention) | D-28 | 1.0 | D-28 | 1.0 | 0.63 |
| 116 (Invention) | D-34 | 1.0 | D-34 | 1.0 | 1.02 |

*1) the sum of the Hammett constants σ values of $R_5$ to $R_9$

The amount added is represented by the molar ratio to the amount of the coupler of each layer of photographic material 101.

Developing Agent A

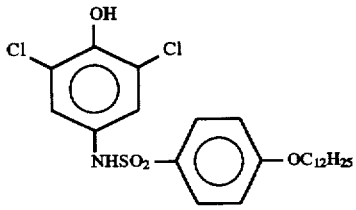

-continued

Developing Agent B

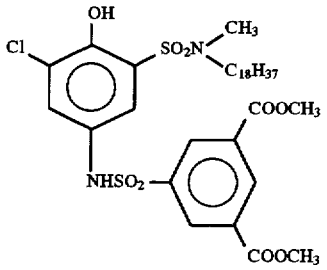

Developing Agent C

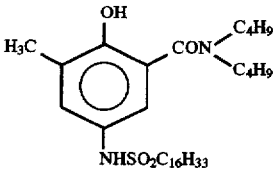

TABLE 7

Sensitometry of Samples

| Sample | Cyan Dmax | Cyan Dmin | Magenta Dmax | Magenta Dmin |
|---|---|---|---|---|
| 101 (Comparison) | 2.15 | 0.14 | 2.35 | 0.18 |
| 102 (Comparison) | 2.25 | 0.14 | 2.45 | 0.19 |
| 103 (Comparison) | 2.26 | 0.15 | 2.42 | 0.18 |
| 104 (Comparison) | 2.02 | 0.14 | 2.10 | 0.18 |
| 105 (Comparison) | 2.17 | 0.15 | 2.31 | 0.18 |
| 106 (Comparison) | 2.37 | 0.15 | 2.43 | 0.19 |
| 107 (Invention) | 3.32 | 0.15 | 3.45 | 0.19 |
| 108 (Invention) | 3.35 | 0.15 | 3.43 | 0.18 |
| 109 (Invention) | 3.33 | 0.14 | 3.44 | 0.18 |
| 110 (Invention) | 2.86 | 0.14 | 2.88 | 0.18 |
| 111 (Invention) | 3.33 | 0.14 | 3.52 | 0.18 |
| 112 (Invention) | 3.31 | 0.14 | 3.50 | 0.19 |
| 113 (Invention) | 2.78 | 0.15 | 2.89 | 0.18 |
| 114 (Invention) | 2.65 | 0.14 | 2.78 | 0.18 |
| 115 (Invention) | 2.58 | 0.15 | 2.69 | 0.19 |
| 116 (Invention) | 2.40 | 0.15 | 2.53 | 0.18 |

The results shown in Table 7 reveal that photographic materials 107 to 116 of the present invention using p-sulfonamidophenol type agents are largely increased in Dmax, as compared to samples 101 to 106 using conventional p-sulfonamidophenol type developing agents. In particular, the results indicate that the effect is particularly significant in photosensitive materials in which the sum of the σ values of the substituents $R_5$ to $R_9$ for the aryl group (i.e., a releasing group) is 0 or less. From the above, the effect of the present invention is remarkable.

EXAMPLE 2

Benzotriazole Silver Emulsion Organic Silver Salt)

In 300 ml of water, 28 g of gelatin and 13.2 g of benzotriazole were dissolved. The resulting solution was maintained at 40° C. and stirred. A solution of 17 g of silver nitrate in 100 ml of water was added to this solution for 2 minutes. The pH of the resulting benzotriazole silver emulsion was adjusted to remove excess salts by sedimentation. Then, the pH was adjusted to 6.30 to obtain 400 g of a benzotriazole silver emulsion.

Using the benzotriazole silver emulsion thus obtained, heat developable color photographic material 201 shown in Table 8 was prepared. Each developing agent was added in the form of an emulsified dispersion of each coupler prepared in the same manner as in Example 1.

TABLE 8

Constitution of Photographic Material 201

| Layer Constitution | Material Added | Amount Added ($mg/m^2$) |
|---|---|---|
| 6th Layer Protective Layer | Lime-Treated Gelatin | 1940 |
| | Matte Agent (Silica) | 200 |
| | Surfactant (8) | 50 |
| | Surfactant (9) | 300 |
| | Base Precursor (11) | 1400 |
| | Water-Soluble Polymer(10) | 120 |
| 5th Layer Yellow Color Formation Layer | Lime-Treated Gelatin | 1700 |
| | Blue-Sensitive Silver Halide Emulsion | 864 (converted to silver) |
| | Benzotriazole Silver Emulsion | 200 (converted to silver) |
| | Yellow Coupler (3) | 336 |
| | Developing Agent (5) | 570 |
| | Antifoggant (13) | 16 |
| | High Boiling Solvent (6) | 453 |
| | Surfactant (7) | 80 |
| | Thermal Solvent (12) | 1400 |
| | Surfactant (9) | 70 |
| | Water-Soluble Polymer (10) | 40 |
| 4th Layer Intermediate Layer | Lime-Treated Gelatin | 970 |
| | Surfactant (8) | 50 |
| | Surfactant (9) | 300 |
| | Base Precursor (11) | 1400 |
| | Water-Soluble Polymer (10) | 60 |
| 3rd Layer Magenta Color Formation Layer | Lime-Treated Gelatin | 1700 |
| | Green-Sensitive Silver Halide Emulsion | 864 (converted to silver) |
| | Benzotriazole Silver Emulsion | 200 (converted to silver) |
| | Magenta Coupler (2) | 318 |
| | Developing Agent (4) | 467 |
| | Antifoggant (13) | 8 |
| | High Boiling Solvent (6) | 388 |
| | Surfactant (7) | 40 |
| | Thermal Solvent (12) | 700 |
| | Surfactant (9) | 35 |
| | Water-Soluble Polymer (10) | 20 |
| 2nd Layer Intermediate Layer | Lime-Treated Gelatin | 970 |
| | Surfactant (8) | 50 |
| | Surfactant (9) | 300 |
| | Base Precursor (11) | 1400 |
| | Water-Soluble Polymer (10) | 60 |
| 1st Layer Cyan Color Formation Layer | Lime-Treated Gelatin | 1700 |
| | Red-Sensitive Silver Halide Emulsion | 864 (converted to silver) |
| | Benzotriazole Silver Emulsion | 200 (converted to silver) |
| | Cyan Coupler (1) | 435 |

TABLE 8-continued

Constitution of Photographic Material 201

| Layer Constitution | Material Added | Amount Added (mg/m²) |
|---|---|---|
| | Developing Agent (4) | 467 |
| | Antifoggant (13) | 8 |
| | High Boiling Solvent (6) | 451 |
| | Surfactant (7) | 40 |
| | Thermal Solvent (12) | 700 |
| | Surfactant (9) | 35 |
| | Water-Soluble Polymer (10) | 20 |
| Syndiotactic Polystyrene Film (Manufactured by Idemitsu Petrochemical Co., Ltd.) | | |
| Base Precursor (11) | | |

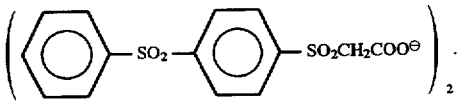

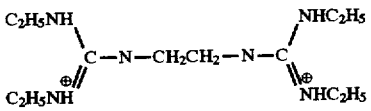

| | | |
|---|---|---|
| Thermal Solvent (12) | | |
| D-Sorbitol | | |
| Antifoggant (13) | | |

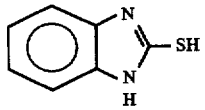

Then, photographic materials 202 to 212 were prepared in the same manner as the preparation of photographic material 201 except that the developing agents contained in the first and third layers were changed as shown in Table 9. Photographic materials 201 to 212 thus obtained were each exposed at 2000 lux for 1 second through B, G and R wedges continuously changed in density. The exposed sample was brought into contact with a heat drum heated at 130° C. on its back side to heat it for 10 seconds. Upon separation from the drum after processing, color images of cyan, magenta and yellow were clearly obtained on the photographic material corresponding to the B, G and R filters. Immediately after processing, the maximum density (Dmax) and the minimum density (Dmin) of this sample were measured with an X-rite densitometer. Results are shown in Table 10.

TABLE 9

| Sample | Cyan Agent | Cyan Amount Added | Magenta Agent | Magenta Amount Added | Hammett σ Value of Releasing Group of Aqent*¹ |
|---|---|---|---|---|---|
| 201 (Comparison) | (4) | 1.0 | (4) | 1.0 | — |
| 202 (Comparison) | A | 1.0 | A | 1.0 | −0.32 |
| 203 (Comparison) | B | 1.0 | B | 1.0 | 0.74 |
| 204 (Comparison) | C | 1.0 | C | 1.0 | — |
| 205 (Comparison) | B | 2.0 | B | 2.0 | 0.74 |

TABLE 9-continued

| Sample | Cyan Agent | Cyan Amount Added | Magenta Agent | Magenta Amount Added | Hammett σ Value of Releasing Group of Aqent*¹ |
|---|---|---|---|---|---|
| 206 (Invention) | D-1 | 1.0 | D-1 | 1.0 | −0.45 |
| 207 (Invention) | D-3 | 1.0 | D-3 | 1.0 | −0.66 |
| 208 (Invention) | D-7 | 1.0 | D-7 | 1.0 | −0.36 |
| 209 (Invention) | D-12 | 1.0 | D-12 | 1.0 | −0.45 |
| 210 (Invention) | D-21 | 1.0 | D-21 | 1.0 | 0.50 |
| 211 (Invention) | D-23 | 1.0 | D-23 | 1.0 | 0.72 |
| 212 (Invention) | D-34 | 1.0 | D-35 | 1.0 | 1.02 |

*¹) the sum of the Hammett constants σ values of $R_5$ to $R_9$

The amount added is represented by the molar ratio to the amount of the coupler of each layer of photographic material 201.

TABLE 10

Sensitometry of Samples

| Sample | Cyan Dmax | Cyan Dmin | Magenta Dmax | Magenta Dmin |
|---|---|---|---|---|
| 201 (Comparison) | 2.01 | 0.15 | 2.15 | 0.19 |
| 202 (Comparison) | 2.10 | 0.16 | 2.24 | 0.19 |
| 203 (Comparison) | 1.92 | 0.16 | 2.01 | 0.18 |
| 204 (Comparison) | 2.01 | 0.15 | 2.16 | 0.18 |
| 205 (Comparison) | 2.11 | 0.16 | 2.20 | 0.18 |
| 206 (Invention) | 2.95 | 0.16 | 3.02 | 0.19 |
| 207 (Invention) | 2.94 | 0.15 | 3.05 | 0.18 |
| 208 (Invention) | 2.93 | 0.15 | 3.03 | 0.18 |
| 209 (Invention) | 2.99 | 0.15 | 3.04 | 0.19 |
| 210 (Invention) | 2.35 | 0.16 | 2.78 | 0.18 |
| 211 (Invention) | 2.41 | 0.15 | 2.77 | 0.19 |
| 212 (Invention) | 2.26 | 0.15 | 2.65 | 0.19 |

The results shown in Table 10 reveal that similarly to Example 1, photographic materials 206 to 212 using p-sulfonamidophenol type developing agents of the present invention were largely increased in Dmax, as compared to samples 201 to 205 using conventional p-sulfonamidophenol type developing agents. Further, also for the substituent group effect of releasing groups, an effect similar to that of Example 1 was observed.

According to the present invention, the color photographic materials excellent in discrimination are obtained.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising on a support at least one compound represented by formula (1):

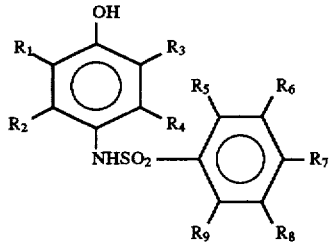

(1)

wherein:

$R_1$ and $R_3$ each represents a hydrogen atom or a substituent and at least one of $R_1$ and $R_3$ is an electron-withdrawing group having a Hammett substituent constant σp of 0.20 to 1.0;

$R_2$ and $R_4$ each represents a hydrogen atom;

the sum of the Hammett substituent constants $\sigma_p$ values of $R_1$ to $R_4$ is 0 or more;

$R_5$ to $R_9$ each represents a hydrogen atom or a substituent and at least one of $R_5$ and $R_9$ is a halogen atom, an amino group, an alkyl group, an aryl group, an acylamino group, a sulfonamido group, an alkoxycarbonylamino group, an aryloxycarbonylamino group, a ureido group, a phosphorylamino group, an alkoxycarbonyl group, an aryloxycarbonyl group, an alkylsulfonyl group, an arylsulfonyl group, an acyloxy group, or a carbamoyloxy group;

the sum of the Hammett substituent constants σ values of $R_5$ to $R_9$ is 0 or less;

at least one of $R_1$ and $R_3$ has a ballasting group having 8 or more carbon atoms or the total carbon number of $R_5$ to $R_9$ is 8 or more; and $R_1$ and $R_2$, $R_5$ and $R_6$, $R_6$ and $R_7$, $R_7$ and $R_8$, or $R_8$ and $R_9$ may combine with each other to form a ring.

2. The silver halide photographic material of claim 1, wherein $R_1$ and $R_3$, which may be the same or different, are selected from the group consisting of a halogen atom, an alkyl group, an aryl group, an alkylcarbonamido group, an arylcarbonamido group, an alkoxyl group, an aryloxy group, an alkylthio group, an arylthio group, an alkylcarbamoyl group, an arylcarbamoyl group, a carbamoyl group, an alkylsulfamoyl group, an arylsulfamoyl group, an sulfamoyl group, a cyano group, an alkylsulfonyl group, an arylsulfonyl group, an alkoxycarbonyl group, an aryloxycarbonyl group, an alkylcarbonyl group, an arylcarbonyl group and an acyloxy group.

3. The silver halide photographic material of claim 1, wherein the electron-withdrawing group having a Hammett constant $\sigma_p$ of 0.20 to 1.0 is selected from the group consisting of a halogen atom, a carbamoyl group, a sulfamoyl group, an alkoxycarbonyl group, an acyl group, and a cyano group.

4. The silver halide photographic material of claim 1, wherein the ring which $R_5$ and $R_6$, $R_6$ and $R_7$, $R_7$ and $R_8$, or $R_8$ and $R_9$ may form is selected from a naphthalene ring, a tetralin ring and a coumarin ring.

5. The silver halide photographic material of claim 1, wherein $R_5$ and/or $R_9$ is selected from the group consisting of a halogen atom, an amino group, an alkyl group, an aryl group, an acylamino group, a sulfonamido group, an alkoxycarbonylamino group, an aryloxycarbonylamino group, a ureido group, a phosphorylamino group, an alkoxycarbonyl group, an aryloxycarbonyl group, an alkylsulfonyl group, an arylsulfonyl group, an acyloxy group and a carbamoyl group.

6. The silver halide photographic material of claim 1, wherein $R_5$ and/or $R_9$ is selected from the group consisting of an alkyl group, an aryl group, an acylamino group and a sulfonamido group.

7. The silver halide photographic material of claim 1, wherein $R_5$ and $R_9$ each represents an alkyl group.

8. The silver halide photographic material of claim 1, wherein the total carbon number of $R_5$ and $R_9$ is 6 or more.

9. A heat developable color photographic material comprising a support having provided thereon a photosensitive silver halide, a binder, a coupler, and at least one compound represented by formula (1):

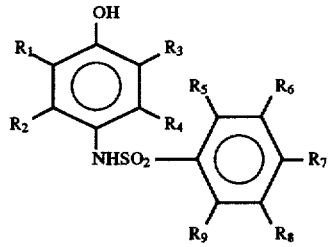

(1)

wherein:

$R_1$ and $R_3$ each represents a hydrogen atom or a substituent and at least one of $R_1$ and $R_3$ is an electron-withdrawing group having a Hammett substituent constant $\sigma_p$ of 0.20 to 1.0;

$R_2$ and $R_4$ each represents a hydrogen atom;

the sum of the Hammett substituent constants $\sigma_p$ values of $R_1$ to $R_4$ is 0 or more;

$R_5$ to $R_9$ each represents a hydrogen atom or a substituent and at least one of $R_5$ and $R_9$ is a halogen atom, an amino group, an alkyl group, an aryl group, an acylamino group, a sulfonamido group, an alkoxycarbonylamino group, an aryloxycarbonylamino group, a ureido group, a phosphorylamino group, an alkoxycarbonyl group, an aryloxycarbonyl group, an alkylsulfonyl group, an arylsulfonyl group, an acyloxy group, or a carbamoyloxy group;

the sum of the Hammett substituent constants σ values of $R_5$ to $R_9$ is 0 or less;

at least one of $R_1$ and $R_3$ has a ballasting group having 8 or more carbon atoms or the total carbon number of $R_5$ to $R_9$ is 8 or more; and $R_5$ and $R_6$ or $R_8$ and $R_9$ may combine with each other to form a ring.

10. The heat developable color photographic material of claim 9, wherein $R_1$ and $R_3$, which may be the same or different, are selected from the group consisting of a halogen atom, an alkyl group, an aryl group, an alkylcarbonamido group, an arylcarbonamido group, an alkoxyl group, an aryloxy group, an alkylthio group, an arylthio group, an alkylcarbamoyl group, an arylcarbamoyl group, a carbamoyl group, an alkylsulfamoyl group, an arylsulfamoyl group, an sulfamoyl group, a cyano group, an alkylsulfonyl group, an arylsulfonyl group, an alkoxycarbonyl group, an aryloxycarbonyl group, an alkylcarbonyl group, an arylcarbonyl group and an acyloxy group.

11. The heat developable color photographic material of claim 9, wherein the electron-withdrawing group having a Hammett constant $\sigma_p$ of 0.20 to 1.0 is selected from the group consisting of a halogen atom, a carbamoyl group, a sulfamoyl group, an alkoxycarbonyl group, an acyl group, and a cyano group.

12. The heat developable color photographic material of claim 9, wherein the ring which $R_5$ and $R_6$, or $R_8$ and $R_9$ may form is selected from a naphthalene ring, a tetralin ring and a coumarin ring.

13. The heat developable color photographic material of claim 9, wherein $R_5$ and/or $R_9$ is selected from the group consisting of a halogen atom, an amino group, an alkyl group, an aryl group, an acylamino group, a sulfonamido group, an alkoxycarbonylamino group, an aryloxycarbonylamino group, a ureido group, a phosphorylamino group, an alkoxycarbonyl group, an aryloxycarbonyl group, an alkylsulfonyl group, an arylsulfonyl group, an acyloxy group and a carbamoyl group.

14. The heat developable color photographic material of claim 9, wherein $R_5$ and/or $R_9$ is selected from the group consisting of an alkyl group, an aryl group, an acylamino group and a sulfonamido group.

15. The heat developable color photographic material of claim 9, wherein $R_5$ and $R_9$ each represents an alkyl group.

* * * * *